US008465321B2

(12) United States Patent
Montena

(10) Patent No.: US 8,465,321 B2
(45) Date of Patent: Jun. 18, 2013

(54) PROTRUDING CONTACT RECEIVER FOR MULTI-CONDUCTOR COMPRESSION CABLE CONNECTOR

(75) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 211 days.

(21) Appl. No.: 13/015,073

(22) Filed: Jan. 27, 2011

(65) Prior Publication Data

US 2011/0306226 A1 Dec. 15, 2011

Related U.S. Application Data

(63) Continuation-in-part of application No. 12/946,157, filed on Nov. 15, 2010.

(60) Provisional application No. 61/353,187, filed on Jun. 9, 2010.

(51) Int. Cl.
*H01R 9/05* (2006.01)

(52) U.S. Cl.
USPC ..... 439/579; 439/584

(58) Field of Classification Search
USPC ..... 439/579, 580, 660, 607.45, 271, 439/592
See application file for complete search history.

(56) References Cited

U.S. PATENT DOCUMENTS

| | | | | |
|---|---|---|---|---|
| 2,238,834 A | | 4/1941 | Travers | |
| 2,449,983 A | | 9/1948 | Devol | |
| 2,761,110 A | | 8/1956 | Edlen et al. | |
| 3,133,777 A | * | 5/1964 | Anhalt | 439/350 |
| 3,184,706 A | | 5/1965 | Atkins | |
| 3,336,563 A | | 8/1967 | Hyslop | |
| 3,683,320 A | | 8/1972 | Woods et al. | |
| 3,706,958 A | | 12/1972 | Blanchenot | |
| 4,150,866 A | * | 4/1979 | Snyder et al. | 439/275 |
| 4,261,632 A | | 4/1981 | Narozny | |
| 4,352,240 A | | 10/1982 | Komada | |
| 4,374,458 A | | 2/1983 | Komada | |
| 4,553,806 A | | 11/1985 | Forney, Jr. et al. | |
| 4,557,546 A | | 12/1985 | Dreyer | |

(Continued)

FOREIGN PATENT DOCUMENTS

DE 4229812 C1 3/1994

OTHER PUBLICATIONS

Office Action (Date Mailed: Oct. 7, 2011) for U.S. Appl. No. 12/955,978, filed Nov. 30, 2010; Confirmation No. 8551.

(Continued)

*Primary Examiner* — Hae Moon Hyeon
(74) *Attorney, Agent, or Firm* — Schmeiser, Olsen & Watts LLP

(57) ABSTRACT

A multi-conductor cable connector is provided, the connector including a contact receiver, having a first end and a second end, disposed substantially within an outer housing of a multi-conductor cable connector, wherein a portion of the contact receiver extends an axial distance beyond the outer housing, a plurality of openings configured to receive a plurality of non-concentrically aligned electrical contacts, the plurality of openings being surrounded by the contact receiver, and a securing mechanism positioned proximate the contact receiver, the securing mechanism having a latch arm, wherein axial compression of the contact receiver establishes and maintains firm electrical and physical contact with the received non-concentrically aligned electrical contacts and biases the latch arm of the securing mechanism. Furthermore, an associated method is also provided.

25 Claims, 19 Drawing Sheets

U.S. PATENT DOCUMENTS 4,688,877 A 8/1987 Dreyer
4,758,174 A * 7/1988 Michaels et al. ..... 439/281
4,789,355 A 12/1988 Lee
4,799,902 A 1/1989 Laudig et al.
5,066,248 A 11/1991 Gaver, Jr. et al.
5,073,129 A 12/1991 Szegda
5,154,637 A 10/1992 Klug et al.
5,261,839 A 11/1993 Franks, Jr.
5,318,458 A 6/1994 Thorner
5,362,251 A 11/1994 Bielak
5,470,257 A 11/1995 Szegda
5,527,190 A 6/1996 Weingartner
5,595,497 A * 1/1997 Wood ..... 439/282
5,890,925 A 4/1999 Bernardini
5,997,350 A 12/1999 Burris et al.
6,109,963 A 8/2000 Follingstad et al.
6,116,945 A 9/2000 Davis et al.
6,123,567 A 9/2000 McCarthy
6,149,469 A 11/2000 Kim
6,153,830 A 11/2000 Montena
6,179,656 B1 1/2001 Wong
6,210,222 B1 4/2001 Langham et al.
6,254,430 B1 7/2001 Endo et al.
6,261,126 B1 7/2001 Stirling
6,331,123 B1 12/2001 Rodrigues
6,517,379 B2 2/2003 Leve
6,558,194 B2 5/2003 Montena
6,568,964 B2 5/2003 D'Addario
6,575,784 B1 6/2003 Yamada
6,644,993 B2 11/2003 Victor
6,676,446 B2 1/2004 Montena
6,705,884 B1 3/2004 McCarthy
6,722,902 B2 4/2004 Kedzierski
6,729,912 B2 5/2004 D'Addario
6,749,454 B2 6/2004 Schmidt et al.
6,764,350 B2 7/2004 Kosmala
6,786,774 B2 9/2004 Haas, II et al.
6,848,940 B2 2/2005 Montena
6,860,760 B2 3/2005 Endo et al.
6,884,113 B1 4/2005 Montena
6,966,796 B2 11/2005 Abe et al.
7,029,326 B2 4/2006 Montena
7,048,579 B2 5/2006 Montena
7,094,103 B2 8/2006 Lai
7,118,416 B2 * 10/2006 Montena et al. ..... 439/584
7,121,872 B1 10/2006 Hanks
7,153,159 B2 12/2006 Burris et al.
7,156,695 B2 1/2007 Holliday
D542,225 S 5/2007 Victor
7,217,155 B2 5/2007 Montena
7,226,320 B2 6/2007 Abe et al.
7,311,554 B1 12/2007 Jackson et al.
7,458,849 B2 12/2008 Rodrigues et al.
7,458,851 B2 12/2008 Montena
7,476,119 B2 1/2009 D'Addario et al.
7,488,187 B2 2/2009 Wolf
7,841,898 B1 11/2010 Titus
7,857,643 B2 * 12/2010 Dobler ..... 439/172
7,997,929 B2 8/2011 Montena
8,016,615 B2 9/2011 Montena
8,348,692 B2 1/2013 Montena
2003/0207620 A1 11/2003 Haas, II et al.
2003/0224658 A1 12/2003 Koch et al.
2005/0085125 A1 4/2005 Montena
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 6/2010 Nania et al.
2010/0203760 A1 8/2010 Montena
2010/0261381 A1 10/2010 Montena et al.
2011/0039449 A1 2/2011 Montena
2011/0059648 A1 3/2011 Montena
2011/0059649 A1 3/2011 Montena
2011/0237110 A1 9/2011 Montena
2011/0300747 A1 12/2011 Montena
2011/0306226 A1 12/2011 Montena
2011/0306247 A1 12/2011 Montena
2012/0003870 A1 1/2012 Montena
2012/0094521 A1 4/2012 Montena
2012/0135629 A1 5/2012 Montena

OTHER PUBLICATIONS

U.S. Appl. No. 13/152,431, filed Jun. 3, 2011; Confirmation No. 6856.
Office Action (Mail Date: Jul. 5, 2012) for U.S. Appl. No. 12/946,157, filed Nov. 15, 2010.
Office Action (Mail Date: Apr. 26, 2012) for U.S. Appl. No. 12/955,978, filed Nov. 30, 2010.
Notice of Allowance (Mail Date: Sep. 11, 2012) for U.S. Appl. No. 12/955,978, filed Nov. 30, 2010.
U.S. Appl. No. 12/946,157, filed Nov. 15, 2010; Confirmation No. 9348; Customer No. 72687.
U.S. Appl. No. 12/955,978, filed Nov. 30, 2010; Confirmation No. 8551; Customer No. 72687.
Office Action (Mail Date: Oct. 7, 2011) for U.S. Appl. No. 12/955,978, filed Nov. 30, 2010; Confirmation No. 8551; Customer No. 72687.
PCT/US2011/039289. International Search Report / Written Opinion. Date of Mailing Feb. 28, 2012. 10 Pages.
Final Office Action (Mail Date: Nov. 8, 2012) for U.S. Appl. No. 12/946,157, filed Nov. 15, 2010.
U.S. Appl. No. 13/716,337, filed Dec. 17, 2012.
Notice of Allowance (Mail Date: Jan. 18, 2013) for U.S. Appl. No. 12/946,157, filed Nov. 15, 2010.

* cited by examiner

PROTRUDING CONTACT RECEIVER FOR MULTI-CONDUCTOR COMPRESSION CABLE CONNECTOR

RELATED APPLICATIONS

This application is a continuation-in-part of U.S. application Ser. No. 12/946,157 filed Nov. 15, 2010, which claims priority to U.S. Provisional Application No. 61/353,187 filed Jun. 9, 2010, with the United States Patent and Trademark Office.

FIELD OF TECHNOLOGY

The following relates to multi-conductor cable communications, and more specifically to embodiments of a multi-conductor cable connector configured for compression type multi-conductor cable connection.

BACKGROUND

Multi-conductor cables, such as those used in microphone and lighting applications, incorporate multiple electrically isolated conductive strands bound together in a single cable. Often multi-conductor cables have a pair of twisted wires surrounded by a braided shield. Multi-conductor cables can also be arranged so that each of the conductive stands are oriented about each other so as to concentrically share a common axis, and may be referred to in a manner that reveals the common axial relationship (e.g. triaxial cable). Common multi-conductor cable connectors utilize multiple electrically isolated terminal contacts corresponding to the multiple conductive strands of the multi-conductor cable. Typically, each of the conductive strands of a multi-conductor cable is soldered to respective terminal contacts of a corresponding common multi-conductor connector. However, soldering can be difficult and time consuming even for experienced technicians, usually requiring special knowledge and precautions for safe implementations. For instance, there is always a possibility that any of the conductive strands of the cable may end up soldered to the wrong conductive terminal contact of the connector, resulting in poor sound quality, or worse, physical harm to a performer holding an ungrounded or improperly grounded microphone or other electronic device associated with the multi-conductor connector.

Moreover, the typical multi-conductor cable, especially the female connector, is a complex assembly because it has multiple socket contacts which must maintain firm electrical contact over numerous mating cycles. In addition, a latching mechanism can be present to secure the female and the male portions of the connection. Multiple, separate components provided in the assembly to support the latching mechanism and improve contact between the sockets and electrical contacts can further the complexity of the assembly of the multi-conductor cable, especially the female portion.

Thus, a need exists for an apparatus and method for a single component that simplifies the assembly by improving electrical contact and improving the latching means.

SUMMARY

A first general aspect relates to a multi-conductor cable connector comprising: a cable connection portion, wherein the cable connection portion receives a prepared cable having a plurality of conductive strands concentrically sharing a common central axis, and a multi-contact portion coupled to the cable connection portion, the multi-contact portion having a plurality of contacts non-concentrically aligned with the cable connection portion.

A second general aspect relates to a multi-conductor cable connector comprising: a cable connection portion including: a post configured for receiving a prepared portion of a multi-conductor cable, a conductive member radially disposed over the post, wherein the conductive member has a first end and a second end, and a connector body physically and electrically contacting the conductive member proximate the second end of the conductive member, the connector further comprising a plurality of electrical contacts non-concentrically aligned with the cable connection portion.

A third general aspect relates to a multi-conductor cable connector device comprising a post configured for receiving a portion of a prepared multi-conductor cable, the prepared multi-conductor cable having at least a first conductive strand layer and a second conductive strand layer, the first and second conductive strand layers concentrically sharing a common central axis, a conductive member radially disposed over the post, wherein an inner sleeve separates the post from the conductive member, a connector body in physical and electrical communication with the conductive member, the connector body receiving a first electrical contact through a first contact opening to extend a continuous electrical ground path through the connector, wherein the connector body has an opening, and a contact component suspended within the opening of the connector body, the contact component having at least two contact openings which receive a second electrical contact and a third electrical contact, wherein the second electrical contact extends a first continuous electrical path through the connector, and the third electrical contact extends a second continuous electrical path through the connector.

A fourth general aspect relates to a method of forming a multi-conductor cable connection, the method comprising providing a multi-conductor cable connector, the multi-conductor cable connector including a cable connection portion, wherein the cable connection portion receives a prepared cable having a plurality of conductive strands concentrically sharing a common central axis, and a multi-contact portion coupled to the cable connection portion, the multi-contact portion having a plurality of contacts non-concentrically aligned with the cable connection portion, and mating the multi-conductor cable connector with a separate device having a corresponding plurality of mating electrical contacts to complete the electrical connection.

A fifth general aspect relates to a multi-conductor cable connector comprising a contact receiver, having a first end and a second end, disposed substantially within an outer housing of a multi-conductor cable connector, wherein a portion of the contact receiver extends an axial distance beyond the outer housing, and a plurality of openings configured to receive a plurality of electrical contacts, the plurality of openings being surrounded by the contact receiver, wherein axial compression of the contact receiver establishes and maintains firm electrical and physical contact with the received electrical contacts.

A sixth general aspect relates to a multi-conductor cable connector comprising an elastomeric member positioned substantially within an outer housing of a multi-contact portion of the multi-conductor cable connector, wherein a portion of the elastomeric member protrudes from the outer housing, the elastomeric member surrounding at least one electrical contact, the at least one electrical contact having a socket positioned at one end of the electrical contact, wherein, when in a mated position with a corresponding multi-conductor cable connector, the elastomeric member is axially compressed and radially expands to bias the at least one electrical contact.

A seventh general aspect relates to a multi-conductor cable connector comprising a cable connection portion, wherein the cable connection portion receives a plurality of conductive strands, and a multi-contact portion coupled to the cable connection portion, the multi-contact portion including: an outer housing disposed over the connector body, a contact receiver having a first end and a second end, the contact receiver positioned substantially within the outer housing, wherein a portion of the contact receiver proximate the second end axially protrudes a distance beyond the outer housing, wherein the connector further includes a plurality of electrical contacts in communication with the plurality of conductive strands received by the cable connection portion.

An eighth general aspect relates to a multi-conductor cable connector comprising a cable connection portion, wherein the cable connection portion receives a plurality of conductive strands, a multi-contact portion coupled to the cable connection portion, the multi-contact portion having a plurality of electrical contacts in communication with the plurality of conductive strands, and means for establishing and maintaining electrical and physical contact with the received non-concentrically aligned electrical contacts and biasing the latch arm of the securing mechanism.

A ninth aspect generally relates to method of improving physical and electrical contact with non-concentrically aligned electrical contacts comprising providing a cable connection portion, wherein the cable connection portion receives a plurality of conductive strands, and a multi-contact portion coupled to the cable connection portion, the multi-contact portion including: an outer housing disposed over the connector body, a contact receiver having a first end and a second end, the contact receiver positioned substantially within the outer housing, wherein a portion of the contact receiver proximate the second end axially protrudes a distance beyond the outer housing, a plurality of electrical contacts in communication with the plurality of conductive strands received by the cable connection portion, wherein, when in a mated position, the contact receiver is axially compressed and radially expands to bias the plurality of electrical contacts.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms “a”, “an” and “the” include plural referents, unless the context clearly dictates otherwise.

Figure 1A:
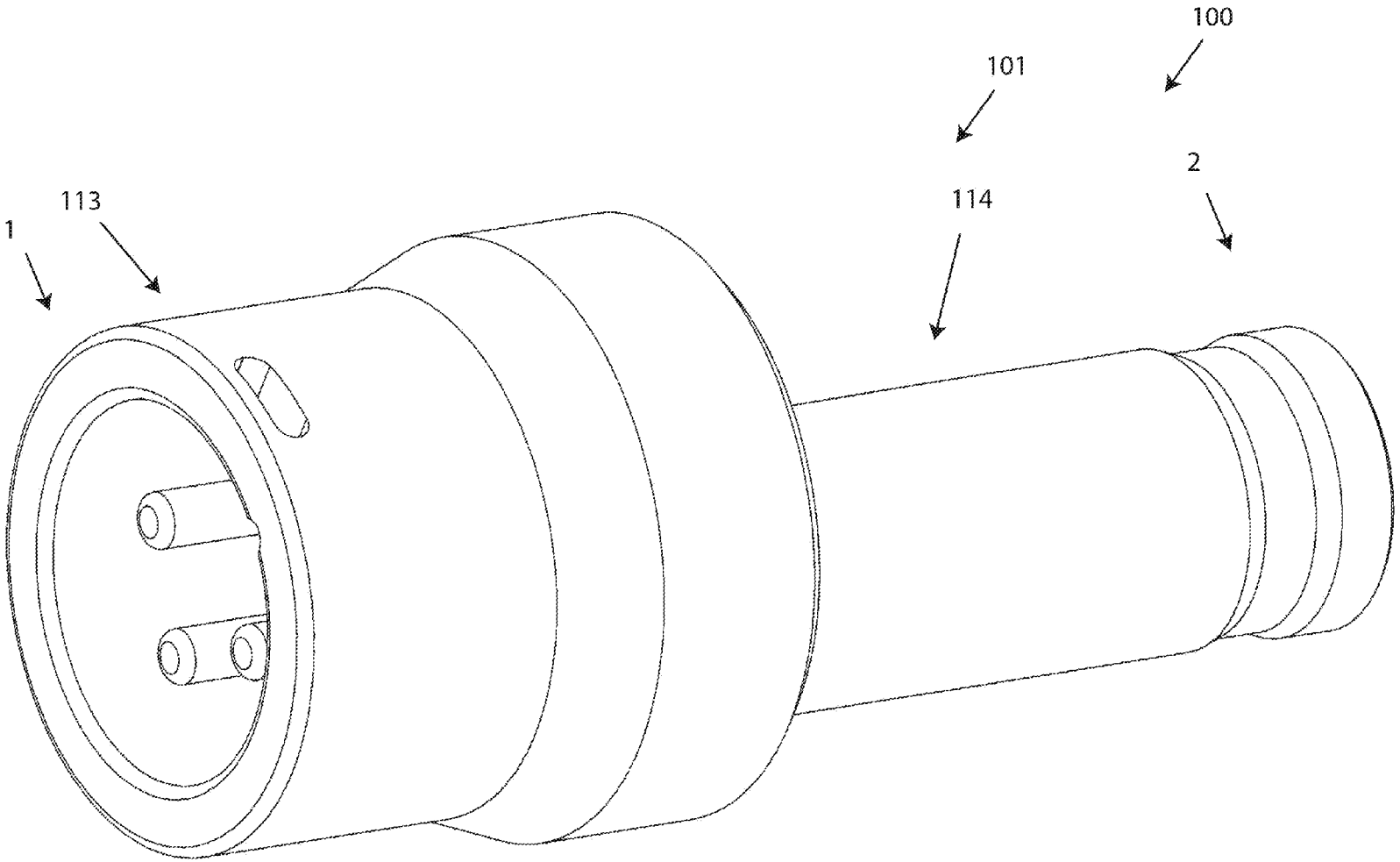
FIG. 1A depicts a perspective view of a first embodiment of a multi-conductor cable connector.
Figure 1B:
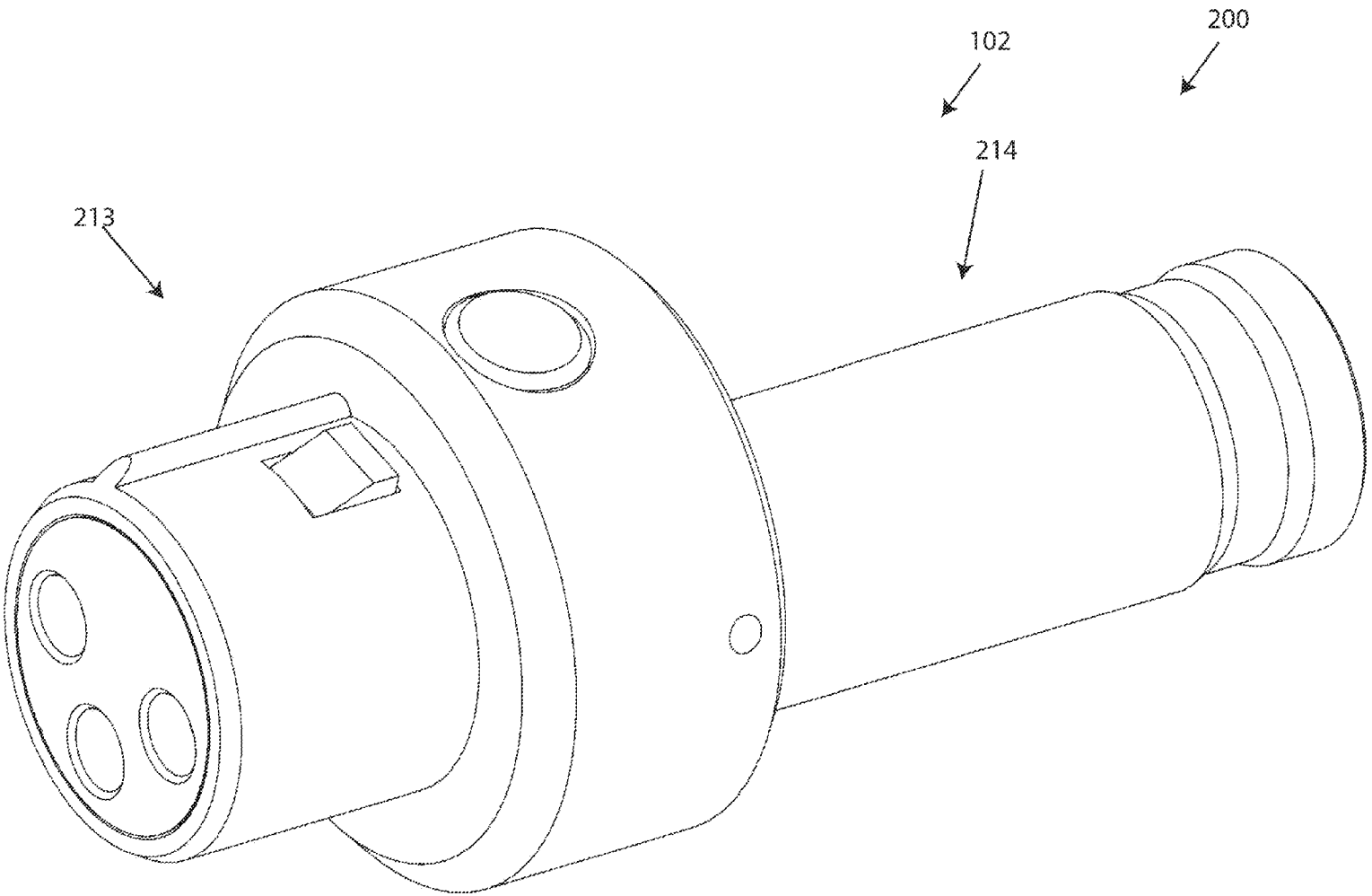
FIG. 1B depicts a perspective view of a second embodiment of a multi-conductor cable connector.

Referring to the drawings, FIG. 1A depicts an embodiment of a multi-conductor cable 100 including embodiments of a multi-contact portion 113 and a cable connection portion 114. The multi-conductor cable connector embodiment 100 may be a male connector 101. FIG. 1B depicts an embodiment of a multi-conductor cable 200 having embodiments of a multi-contact portion 213 and a cable connection portion 214. The multi-conductor cable connector embodiment 200 may be a female connector 102. As depicted in FIG. 1A, connector 100 may include a multi-contact portion 113 coupled to the cable connection portion 14. In one embodiment of a multi-conductor cable connector 100, the multi-contact portion 113 may be coupled to the cable connection portion 114 in coaxial union (e.g. connected at an angle of 0° or 180°) with the cable connection portion 114. In another embodiment, the multi-contact portion 113 may be coupled to the cable connection portion 114 by the use of an additional structural element. In still another embodiment, the multi-contact portion 113 may be partially coupled coaxially to the cable connection portion 114. In still yet another embodiment, the multi-contact portion 113 may be connected to the cable connection portion 114 at an angle other than 0° or 180°.

Embodiments of a multi-conductor cable connector 100, 200 may include a plurality of electrical contacts 110, 120, 130 and 210, 220, 230 configured to engage with the cable connection portion 114, 214.

A multi-conductor cable connector embodiment 100 has a first end 1 and a second end 2, and can be provided to a user in a preassembled configuration to ease handling and installation during use. Multi-conductor cable connector 100 may be a XLR connector, XLR3 connector, any XLR-type connector, tri-axial cable connector, 3-contact connector, and the like. Embodiments of the connector 100 may have a cable connection portion 114. The cable connection portion may include a post 40 configured for receiving a prepared portion of a multi-conductor cable 10, 11. The cable connection portion 114 may also include a conductive member 80 radially disposed over the post 40, wherein the conductive member 80 has a first end 81 and a second end 82. The cable connection portion 114 also includes a connector body 50 that may physically and electrically contact the conductive member 80 proximate the second end 82 of the conductive member 80. Embodiments of a multi-conductor cable connector 100 include a plurality of electrical contacts 110, 120, 130 non-concentrically aligned with the cable connection portion 114. In another embodiment, the connector 100 may have a cable connection portion 114, wherein the cable connection portion 114 receives a prepared multi-conductor cable 10, 11 having a plurality of conductive strands concentrically sharing a common central axis, and a multi-contact portion 113 coupled to the cable connection portion 114, the multi-conductor portion 113 having a plurality of contacts 110, 120, 130 non-concentrically aligned with the cable connection portion 114. In still another embodiment, a multi-conductor cable connector device 100 may include a post 40, the post 40 configured for receiving a prepared multi-conductor cable 10, 11, the prepared multi-conductor cable 10, 11 having a first conductive strand layer 14*a* and a second conductive layer 14*b*, the first and second conductive strand layers concentrically sharing a common central axis. The multi-conductor cable connector device 100 may also include a conductive member 80 radially disposed over the post 40, wherein an inner sleeve 20 may separate the post 40 from the conductive member 80. The inner sleeve 20, may also physically and electromagnetically separate and shield the first conductive strand layer 14*a* from physical and/or electrical contact with the second conductive strand layer 14*b* (as depicted in FIG. 6B). The multi-conductor cable connector device 100 also includes a connector body 50, wherein the connector body 50 may be in physical and electrical communication with the conductive member 80. Moreover, the connector body 50 may be configured to receive a first electrical contact 110 through a first contact opening 54 to extend a continuous electrical ground path through the connector 100. Additionally, the connector body 50 may have an opening 55, and a contact component 30 suspended, or otherwise located, within the opening 55 of the connector body 50. The contact component 30 may have at least two contact openings 34, 35, which openings 34, may receive a second electrical contact 120 and a third electrical contact 130 respectively, wherein the second electrical contact 120 extends a first continuous electrical path through the connector 100, and the third electrical contact 130 extends a second continuous electrical path through the connector 100.

Figure 2:
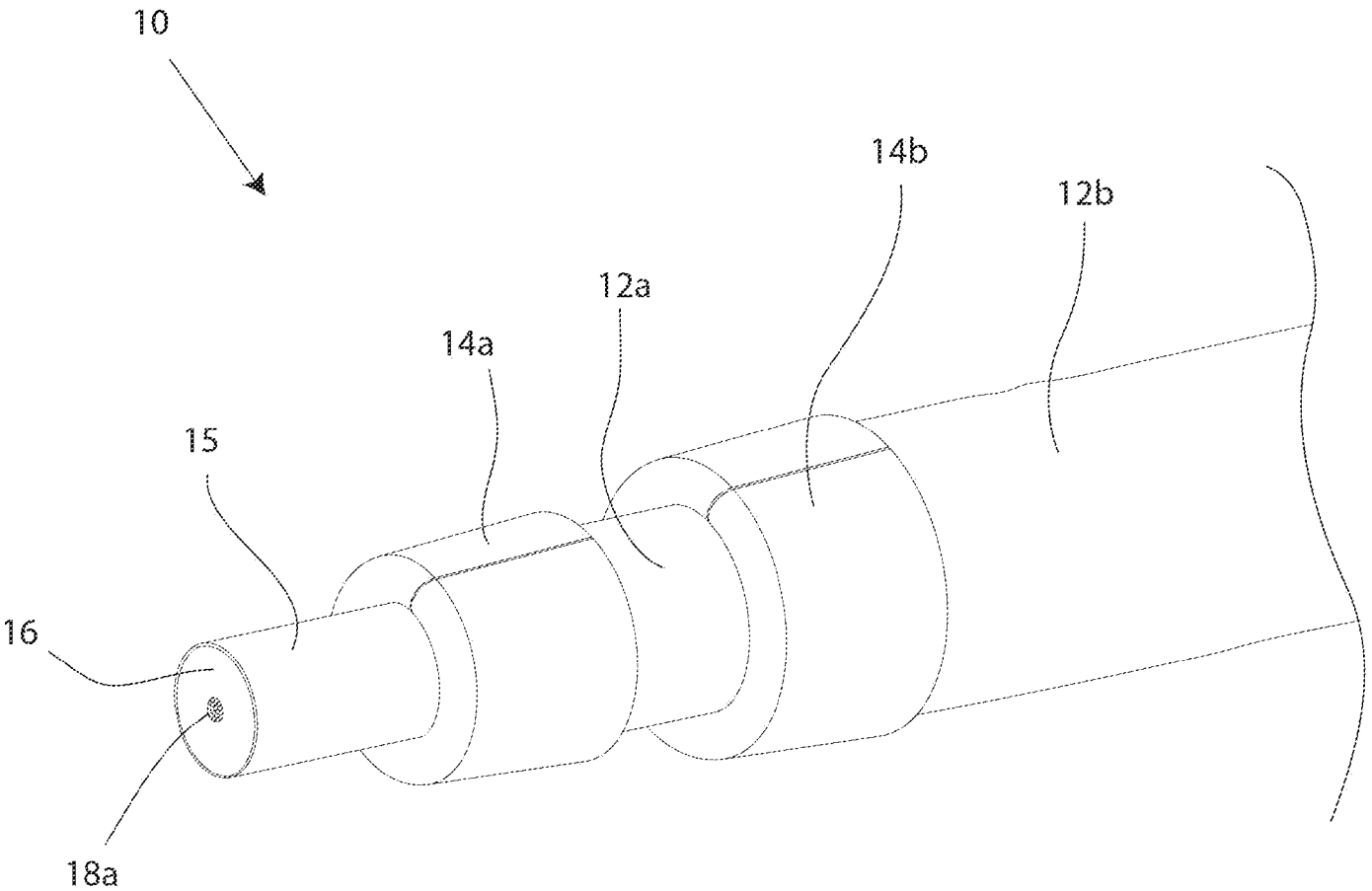
FIG. 2 depicts a perspective view of a first embodiment of a multi-conductor cable having a plurality of conductive strands concentrically sharing a common central axis.

Referring now to FIG. 2, the cable connection portion 114 of a multi-conductor cable connector 100 may be operably affixed to a prepared end of a multi-conductor cable 10 so that the cable 10 is securely attached to the cable connection portion 114. The multi-conductor cable 10 may include a center conductive strand 18*a*, surrounded by an interior dielectric 16; the interior dielectric 16 may possibly be surrounded by a conductive foil layer 15; the interior dielectric (and the possible conductive foil layer 15) is surrounded by a first conductive strand layer 14*a*; the first conductive strand layer 14*a* is surrounded by a first protective outer jacket 12*a*, wherein the first protective outer jacket 12*a* has dielectric properties and serves as an insulator; the first protective outer jacket 12*a* is surrounded by a second conductive strand layer 14*b*; and, the second conductive strand layer 14*b* is surrounded by a second protective outer jacket 12*b*. The second conductive strand layer 14*b* may be the radially outermost conductive strand layer of the cable 10. The second conductive strand layer 14*b* may extend a grounding path providing an electromagnetic shield about the inner conductive strands 14*a* and 18*a* of the multi-conductor cable 10. The multi-conductor cable 10 may be prepared by removing the first protective outer jacket 12*a* and drawing back the first conductive strand layer 14*a* to expose a portion of the interior dielectric 16 (and possibly the conductive foil layer 15 that may tightly surround the interior dielectric 16) and center conductive strand 18*a*. Additionally, the preparation of the cable 10 may include removing the second protective outer jacket 12*b* and drawing back the second conductive grounding shield 14*b* a distance to expose a portion of the first protective outer jacket 12*a*. The protective outer jackets 12*a*, 12*b* can physically protect the various components of the multi-conductor cable 10 from damage which may result from exposure to dirt or moisture, and from corrosion. Moreover, the protective outer jackets 12*a*, 12*b* may serve in some measure to secure the various components of the multi-conductor cable 10 in a contained cable design that protects the cable 10 from damage related to movement during cable installation. The conductive strand layers 14*a*, 14*b* can be comprised of conductive materials suitable for carrying electromagnetic signals and/or providing an electrical ground connection or electrical path connection. The conductive strand layers 14*a*, 14*b* may also be conductive layers, braided layers, and the like. Various embodiments of the conductive strand layers 14*a*, 14*b* may be employed to screen unwanted noise. For instance, the first conductive strand layer 14*a* may comprise a metal foil (in addition to the possible conductive foil 15) wrapped around the dielectric 16 and/or several conductive strands formed in a continuous braid around the dielectric 16. Furthermore, the second conductive strand layer 14*b* may also include a metal foil (in addition to the possible conductive foil 15) wrapped around the first protective outer jacket 12*a* and/or several conductive strands formed in a continuous braid around the first protective outer jacket 12*a*. Combinations of foil and/or braided strands may be utilized wherein the conductive strand layers 14*a*, 14*b* may comprise a foil layer, then a braided layer, and then a foil layer. Those in the art will appreciate that various layer combinations may be implemented in order for the conductive strand layers 14*a*, 14*b* to effectuate an electromagnetic buffer helping to prevent ingress of environmental noise or unwanted noise that may disrupt broadband communications. In most embodiments, there may be more than one conductive strand layer, such as a triaxial, tri-shield, or quad shield cable, etc., and there may also be flooding compounds protecting the conductive strand layers 14*a*, 14*b*. The dielectric 16 may be comprised of materials suitable for electrical insulation. The first protective outer jacket 12*a* may also be comprised of materials suitable for electrical insulation. It should be noted that the various materials of which all the various components of the multi-conductor cable 10 are comprised should have some degree of elasticity allowing the cable 10 to flex or bend in accordance with traditional broadband communications standards, installation methods and/or equipment. It should further be recognized that the radial thickness of the multi-conductor cable 10, protective outer jackets 12*a*, 12*b*, conductive strand layers 14*a*, 14*b*, possible conductive foil layer 15, interior dielectric 16 and/or center conductive strand 18*a* may vary based upon generally recognized parameters corresponding to broadband communication standards and/or equipment.

Figure 3A:
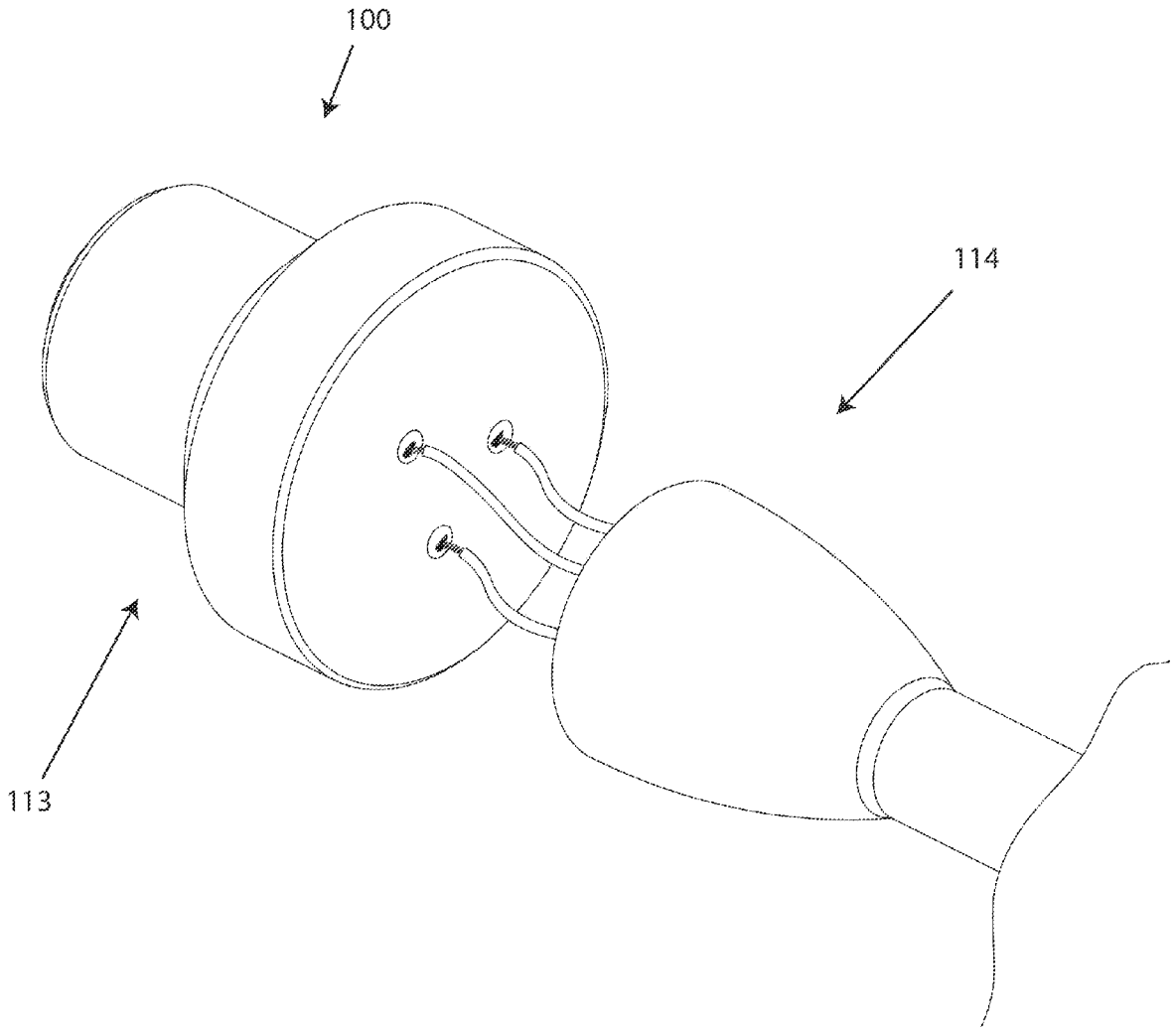
FIG. 3A depicts a schematic view of the first embodiment of a multi-conductor cable connector, wherein a cable connection portion is a soldered connection.

Referring now to FIGS. 3A-5B, embodiments of a cable connection portion 114 of multi-conductor cable connector 100 may be various cable connector configurations. For example, the cable connection portion 114 may be a soldered connection, welded connection, overmold configuration, crimped connection, compression connector, and the like. Cable connection portion 114 may receive a plurality of conductive strands, wherein a plurality of electrical contacts 110, 120, 130 are in communication (e.g. electrical and/or mechanical contact) with the plurality of conductive strands being received by the cable connection portion 114. FIG. 3A depicts an embodiment of cable connection portion 114 being a soldered connection, wherein a plurality of conductive strands can be soldered to a plurality of electrical contacts 110, 120, 130 associated with the connector engagement portion 113. Therefore, connector engagement portion 114 may be coupled to cable connection 114, wherein the cable connection portion 114 may be a compression connector, a soldered connection, overmold configuration, crimped connection, welded connection, or other cable connector configurations.

Referring now to 3B-5B, an embodiment of a cable connection portion 114 will now be described as a compression connector for exemplary purposes; however, cable connection portion 114 may not be a compression connector. Cable connection portion 114 may include a post 40, a connector body 50, a conductive member 80, a fastener member 60, an inner sleeve 20, a contact component 30, an insert 70, and a spacer 135. In other embodiments, such as an embodiment of connector 101, a post 40*b* may be included instead of a slotted contact member 40*a*, as depicted in FIG. 3C.

Embodiments of the cable connection portion 114, 214 of connector embodiments 100, 200 may be substantially structurally similar. As presently depicted, embodiments of a cable connection portion 214 of multi-conductor cable connector 200 may also include a post 40, a connector body 50, a conductive member 80, a fastener member 60, an inner sleeve 20, a contact component 30, an insert 70, and a spacer 135.

An embodiment of a cable connection portion 114 may include a post 40. The post 40 may include a first end 41 and an opposing second end 42. Furthermore, the post 40 may include a thicker portion 45 where the thickness of the post 40 is greater than other sections of the post 40. The thicker portion 45 has a first edge 43 and a second edge 44. The first and second edges 43, 44 may be perpendicularly aligned with the outer surface 46 of the post, or may have any alignment or orientation that could provide a mating edge and/or surface for another component of the multi-conductor cable connector 100. For example, the first and second edges 43, 44 may form a right angle with the surface 46 of the post, or be a tapered surface to accommodate different shaped components. The first edge 43 may be configured to make physical and electrical contact with a corresponding mating surface 36 of a contact component 30. For instance, the mating edge surface, such as first edge 43 of thicker portion 45 of the post 40 may abut, contact, communicate, border, touch, press against, and/or adjacently join with a mating surface, such as mating edge 36, of the contact component 30.

Furthermore, the thicker portion 45 of the post may be a raised portion, an annular extension, an oversized barrel portion, and the like, or may be a separate annular tubular member that tightly surrounds or generally substantially surrounds a portion of the post 40, increasing the thickness of the post 40 for that particular section. The thicker portion 45 may be located proximate or otherwise near the second end 42 of the post 40. Alternatively, the thicker portion 45 may be positioned a distance away from the second end 42 to sufficiently accommodate and/or mate with the contact component 30, depending on the size or desired location of the contact component 30 with respect to the size and/or location of the post 40. Moreover, the post 40 may include a lip 47 proximate or otherwise near the first end 41, such as a lip or protrusion that may engage a portion of an inner sleeve 20. The outer surface 46 of the post 40 may be tapered from the lip 47 to the first end 41. However, the post may not include such a surface feature, such as lip 47, and the cable connection portion 114 may rely on press-fitting and friction-fitting forces and/or other component structures to help retain the post 40 in secure location both axially and rotationally relative to the inner sleeve 20 and conductive member 80.

Figure 5A:
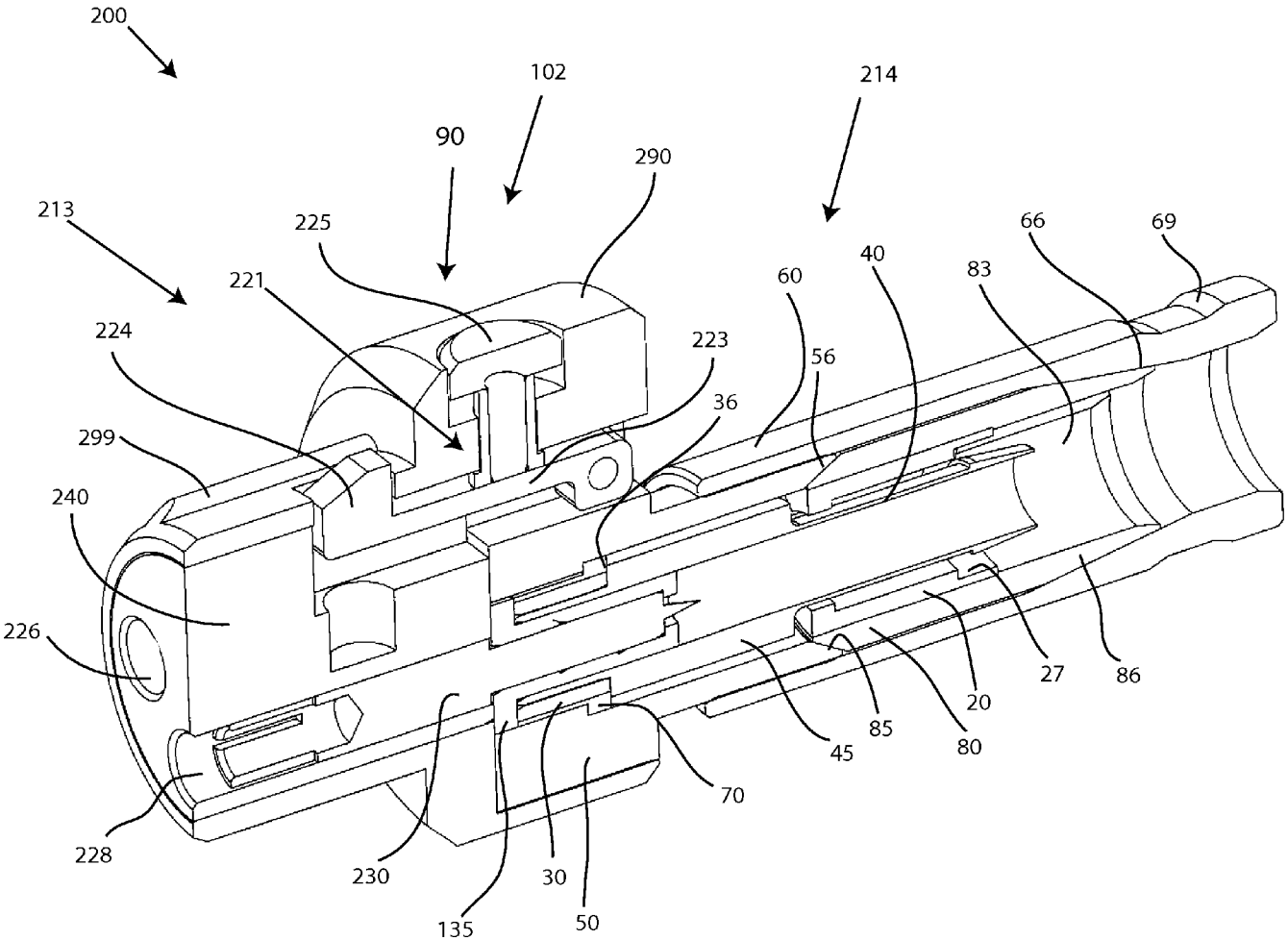
FIG. 5A depicts a perspective cut-away view of the second embodiment of the multi-conductor cable connector.
Figure 5B:
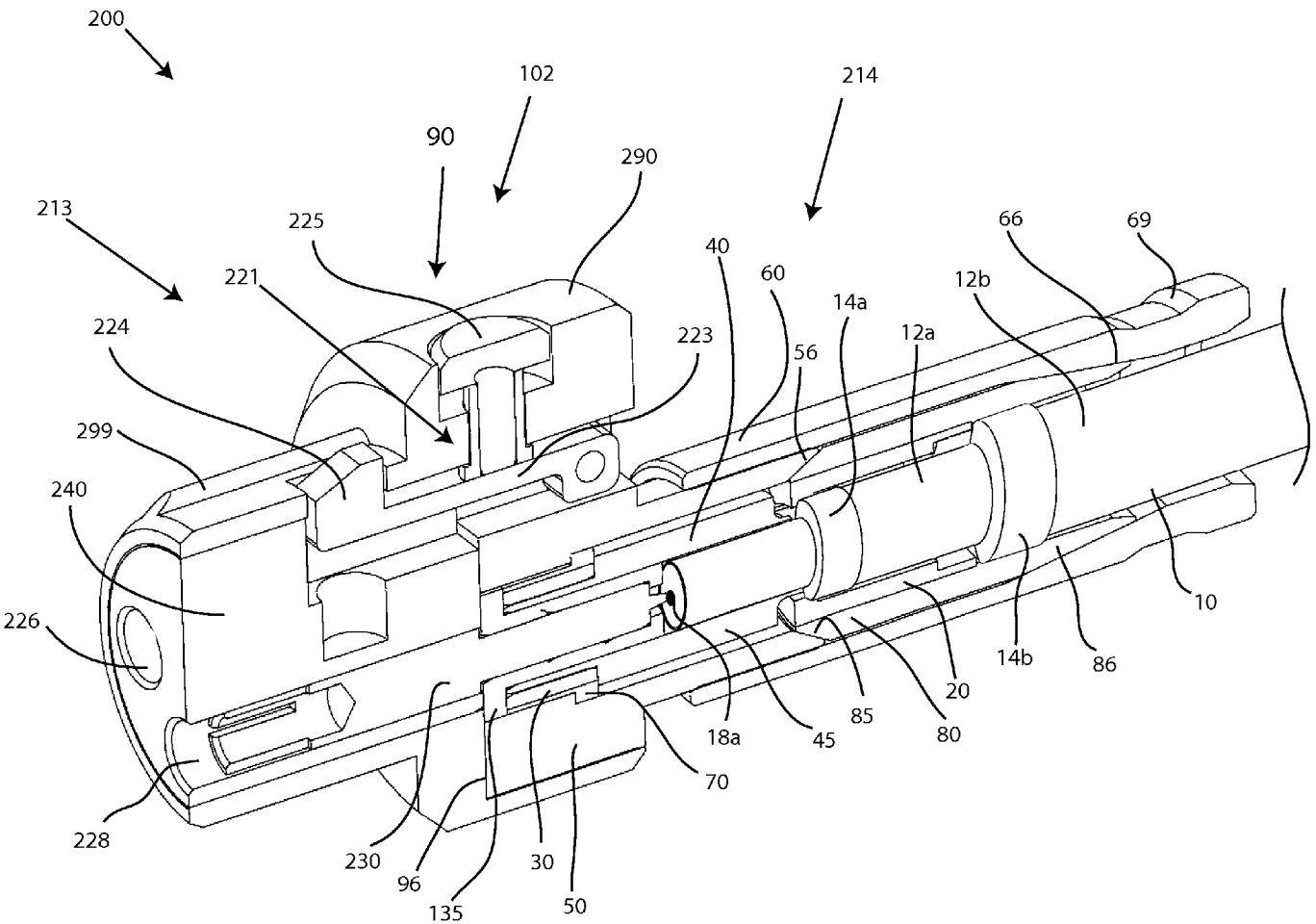
FIG. 5B depicts a perspective cut-away view of the second embodiment of the multi-conductor cable connector having an attached multi-conductor cable.

Moreover, the post 40 should be formed such that portions of a prepared multi-conductor cable 10 (as shown in FIGS. 2, 5B, and 6B) including the dielectric 16 (and possibly a conductive foil 15 tightly surrounding the interior dielectric 16), and center conductive strand 18*a*, 18*b* can pass axially into the first end 41 and/or through a portion of the tube-like body of the post 40. Moreover, the post 40 should be dimensioned such that the post 40 may be inserted into an end of the prepared multi-conductor cable 10, around the surrounding the dielectric 16 (and possible conductive foil 15) and under the first and second protective outer jackets 12*a*, 12*b* and the first and second conductive strand layers 14*a*, 14*b*. Accordingly, where an embodiment of the post 40 may be inserted into an end of the prepared multi-conductor cable 10 under the drawn back conductive strand layer 14*a*, substantial physical and/or electrical contact with the first shield 14*a* may be accomplished thereby facilitating electrical continuity through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer or other non-conductive material. Manufacture of the post 40 may include casting, extruding, cutting, turning, drilling, knurling, injection molding, spraying, blow molding, component overmolding, or other fabrication methods that may provide efficient production of the component.

Figure 3B:
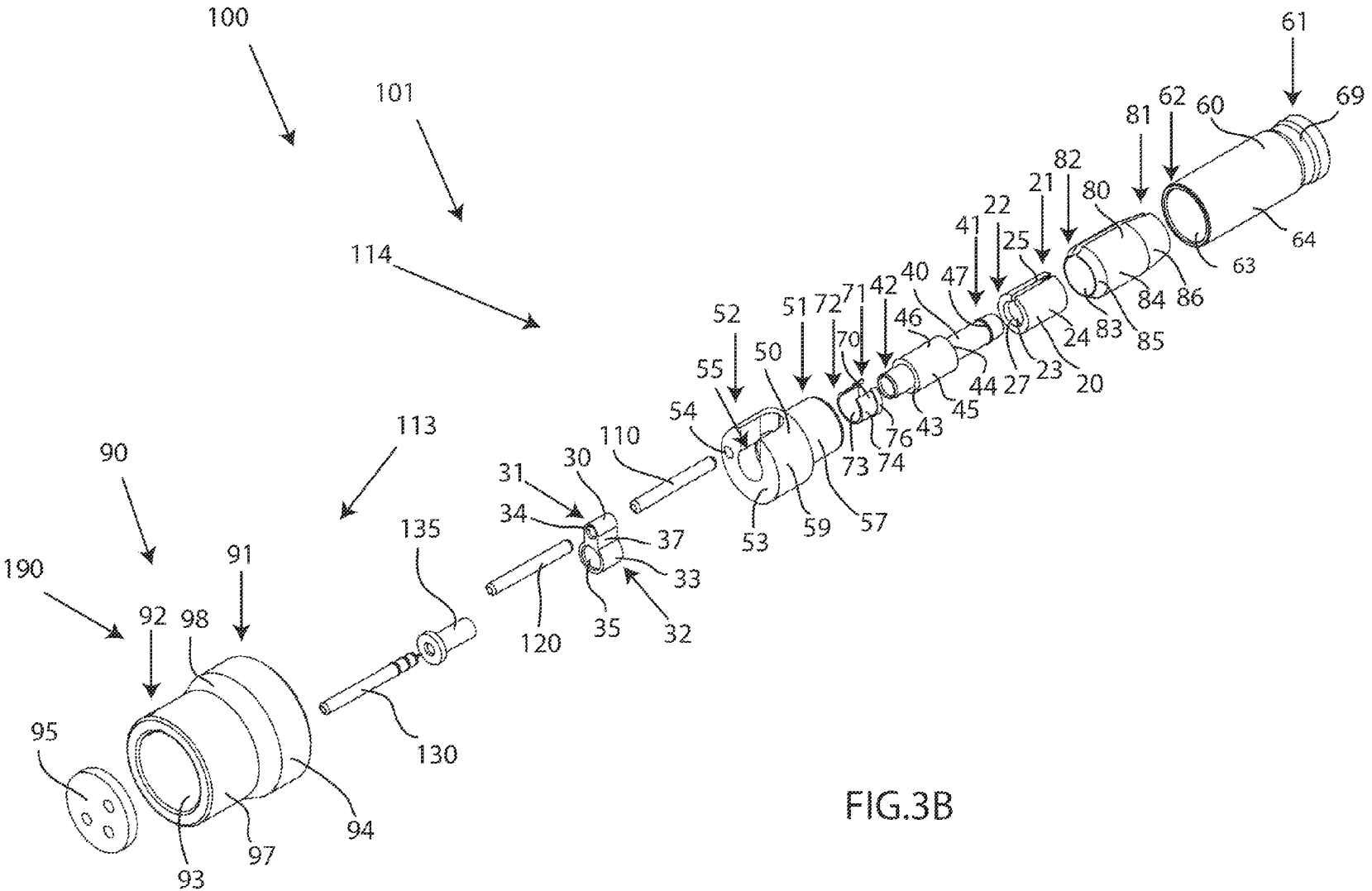
FIG. 3B depicts an exploded perspective view of the first embodiment of the multi-conductor cable connector, wherein the cable connection portion is a compression connector having a post.
Figure 3C:
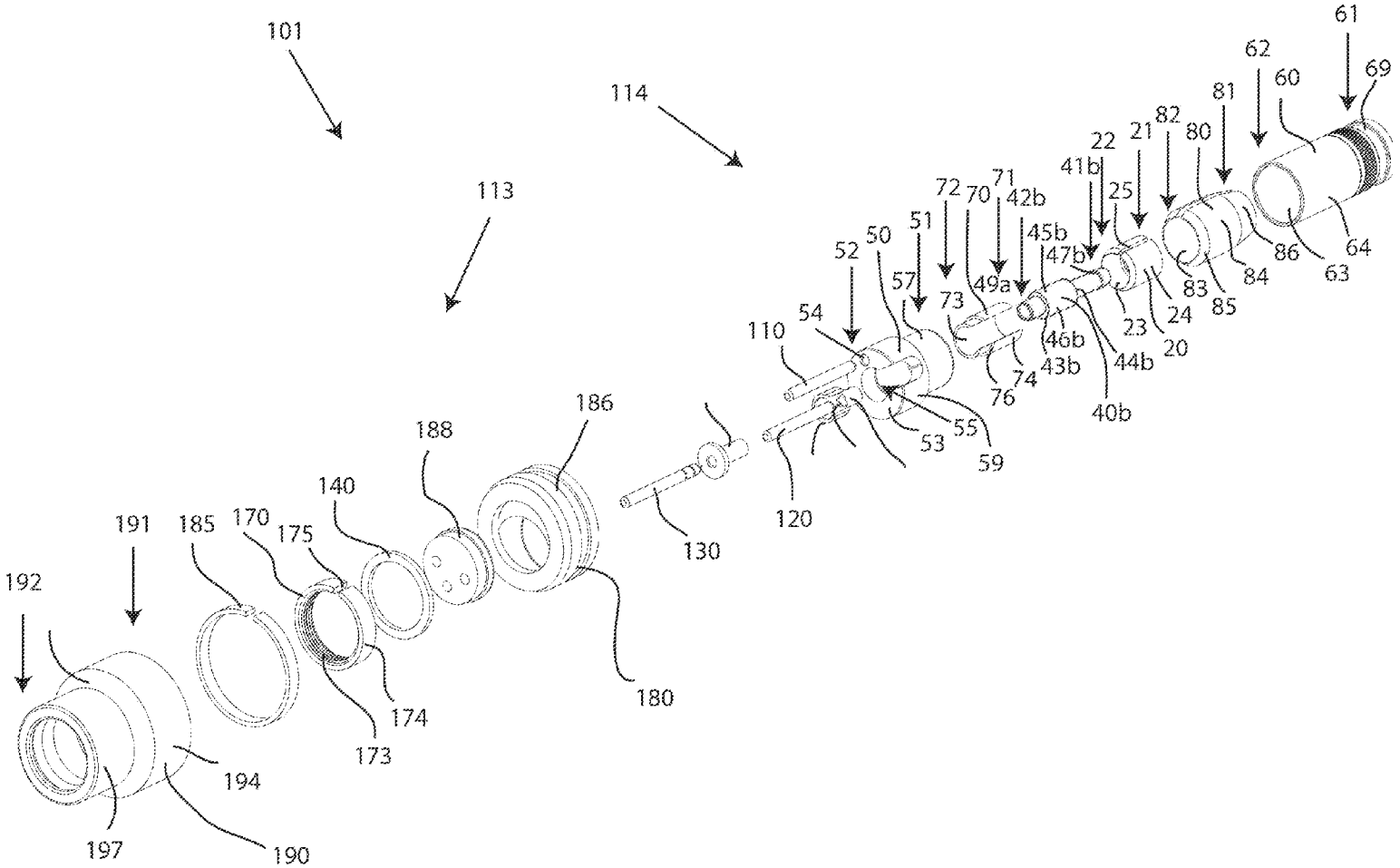
FIG. 3C depicts an exploded perspective view of the first embodiment of the multi-conductor cable connector, wherein the cable connection portion is a compression connector having a slotted contact member.

With continued reference to FIG. 3B, embodiments of a cable connection portion 114 may include a connector body 50. The connector body 50 may comprise a first end 51, opposing second end 52, and an outer surface 59. Proximate or otherwise near the second end 52, the connector body 50 includes a mating surface 53, which may be configured to abut, contact, communicate, border, touch, press against, and/or adjacently join with a mating surface(s), such as an internal lip 96 and plate 95 of outer housing 90, and even spacer 135. Located somewhere on the mating surface 53 may be a first contact opening 54. The first contact opening 54 may accept, accommodate, receive, etc. a first contact 110, and may be an opening, a hole, a bore, a tubular pathway, and the like. In most embodiments, the first contact 110 configured to be inserted into the first contact opening 54 extends a continuous electrical ground path throughout the multi-conductor cable connector 100. The location of the first contact opening 54 may correspond to an arrangement of the first contact 110, wherein the first contact shares a non-concentric alignment with a second contact 120 and a third contact 130. The non-concentric alignment of the contacts 110, 120, 130 could be any non-concentric alignment, or may be a non-concentric alignment associated with most multi-conductor cables designs and standards, such as XLR cables and similar multi-conductor cables.

Furthermore, the connector body 50 may include an opening 55 proximate or otherwise the near the second end 52 which may be dimensioned to allow the contact component 30, insert 70, and a portion of the post 40 to be disposed therein. The opening 55 may be any opening, void, space, cut-out, and the like, which may represent a removed portion of the connector body 50 which may provide clearance for the contact component 30, the insert 70, and a portion of the second end 42 of the post 40. The connector body 50 may also include an internal lip 56, such as a lip or annularly extending protrusion proximate or otherwise near the second end 52, wherein the internal lip 56 may engage a portion of the insert 70, in particular, an outer lip 76 of the insert 70.

Moreover, the connector body 50 may include an annular recess 57 located proximate or otherwise near the first end 51. The outer annular recess 57 may share the same inner surface 58 and may have the same inner diameter as the connector body 50, but may have smaller outer diameter than the connector body 50. The inner diameter of the connector body 50 should be large enough to allow the post 40 to pass axially through the first end 51. Additionally, the connector body 50 may include an annular ramped surface proximate or otherwise near the first end 51 configured to mate with a corresponding annular ramped surface of a conductive member 80. The physical contact between the annular ramped surfaces of the connector body 50 and the conductive member 80 establishes and maintains a continuous electrical ground path throughout the multi-conductor cable 100. Those skilled in the art should appreciate that physical contact may be established and maintained between the connector body 50 and the conductive member 80 without corresponding annular ramped surfaces. For instance, the corresponding mating surfaces may interact with each other by various shapes and/or means, such as abutting flat surfaces, etc. Furthermore, the connector body 50 should be formed of conductive materials to facilitate a continuous electrical ground path throughout the connector 100. Manufacture of the connector body 50 may include casting, extruding, cutting, turning, drilling, injection molding, spraying, blow molding, component overmolding, combinations thereof, or other fabrication methods that may provide efficient production of the component.

With further reference to FIG. 3B, embodiments of a multi-conductor cable connector 100 may include a conductive member 80. The conductive member includes a first end 81, an opposing second end 82, an outer surface 83, and an inner surface 84. The conductive member 80 may have a generally axial opening therethrough. The conductive member 80 may include a first annular ramped surface 85 proximate or otherwise near the second end 82 that may be configured to mate with a corresponding annular ramped surface of the connector body 50 to extend a continuous electrical ground path throughout the connector 100. The conductive member 80 may also include a second annular ramped surface 86 proximate or otherwise near the first end 81 which may be configured to mate with the ramped surface 66 of the fastener member 60 to compress the components of the cable connection portion 114. The conductive member 80 may also include an annular groove 87 proximate or otherwise near the first end 81.

Moreover, the conductive member 80 may be disposed over an inner sleeve 20 and the post 40. Specifically, a first portion of the inner surface 84 proximate or closer to the second end 82 of the conductive member 80 may physically contact the outer surface 24 of the inner sleeve 20 while operably configured, preventing physical and electrical contact with the conductive post 40. A second portion of the inner surface 84 proximate or closer to the first end 81 of the conductive member 80 may physically and electrically contact the drawn back and exposed second conductive grounding shield 14*b* to facilitate a continuous electrical ground path from the second conductive grounding shield 14*b* to the connector body 50. Furthermore, the conductive member 80 should be formed of conductive materials to facilitate a continuous electrical path throughout the connector 100. Manufacture of the conductive member 80 may include casting, extruding, cutting, turning, drilling, injection molding, spraying, blow molding, component overmolding, combinations thereof, or other fabrication methods that may provide efficient production of the component.

Referring still to FIG. 3B, with additional reference to FIGS. 2, 5B and 6B, embodiments of a multi-conductor cable connector 100 and/or 200 may include a fastener member 60. The fastener member 60 may have a first end 61, opposing second end 62, an inner surface 63, and an outer surface 64. In one embodiment, the fastener member 60 may be a compression ring or tubular cylindrical member. The fastener member 60 may be radially disposed over the conductive member 80 and a portion of the connector body 50, in particular, the annular recess 57 of the connector body 50. For example, the outer surface 59 of the connector body 50 and the outer surface 83 of the conductive member 80 may physically contact the inner surface 63 of the fastener member 60. In addition, the fastener member 60 may comprise a central passageway 65 defined between the first end 61 and second end 62 and extending axially through the fastener member 60. The central passageway 65 may comprise a ramped surface 66 proximate or otherwise near the first end 61 which may be configured to mate with the second ramped surface of the conductive member 80. The ramped surface 66 may act to compress the outer surface 84 of the conductive member 80 when the fastener member 60 is operated to secure a multi-conductor cable 10. For example, the narrowing geometry will compress squeeze against the conductive member 80 and other components, when the fastener member 60 is compressed into a tight and secured position. Additionally, the fastener member 60 may comprise an exterior surface feature 69 positioned proximate with or close to the first end 61 of the fastener member 60. The surface feature 69 may facilitate gripping of the fastener member 60 during operation of the cable connection portion 114. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position, the fastener member 60 touches or resides substantially proximate or significantly close to the annular recess 57 of the connector body 50. It should be recognized, by those skilled in the requisite art, that the fastener member 60 may be formed of conductive or non-conductive rigid materials such as metals, hard plastics, polymers, composites and the like, and/or combinations thereof. Furthermore, the fastener member 60 may be manufactured via casting, extruding, cutting, turning, drilling, injection molding, spraying, blow molding, component overmolding, combinations thereof, or other fabrication methods that may provide efficient production of the component.

Referring still to FIG. 3B, further embodiments of cable connection portion 114 may also include an inner sleeve 20. The inner sleeve 20 may include a first end 21, an opposing second end 22, an inner surface 23, and an outer surface 24. The inner sleeve may also include an opening 25 running axially along the inner sleeve 20. The opening 25 may be a slit, slot, opening, or aperture between two portions of the inner sleeve 20. In one embodiment, opening 25 may be formed by an abutment of two edges of a curved piece of polymeric material, such as inner sleeve 20. Alternatively, the opening 25 may be formed by cutting, slicing, scoring, piercing, etc. a whole, one-piece inner sleeve 20 in an axial direction along from a first end 21 to a second end 22. During installation, the inner sleeve 20 may be spread open because of the opening 25 and then subsequently radially disposed over the post 40. Because the inner sleeve 20 is resilient, it can regain a generally annular or cylindrical shape and encompass or substantially surround the post 40.

The inner sleeve 20 may be disposed between the conductive member 80 and the post 40 which may prevent physical and electrical contact between the conductive member 80 and the post 40. The inner sleeve 20, may also physically and electromagnetically separate and shield the first conductive strand layer 14*a* from physical and/or electrical contact with the second conductive strand layer 14*b* (as depicted in FIG. 6B). Specifically, the inner sleeve 20 substantially or generally surrounds, encompasses, and/or has a radial relationship with a portion of the post 40. Additionally, the inner sleeve 20 may include a lip 26 proximate or otherwise near the second end 22. The inner sleeve 20 may also include an annular detent 27 proximate or otherwise near the first end 21. The annular detent 27 may dimensionally correspond to the annular lip 46 of the post 40 for possible engagement at that location with the post 40. Moreover, the inner sleeve 20 should be formed of non-conductive materials, such as an insulator. Moreover, the inner sleeve 20 may be formed of a polymeric material, such as rubber or plastic, or any resilient or semi-resilient insulating material responsive to radial compression and/or deformation. Manufacture of the inner sleeve 20 may include casting, extruding, cutting, turning, drilling, compression molding, injection molding, spraying, or other fabrication methods that may provide efficient production of the component.

With continued reference to FIGS. 3B-6B, embodiments of a cable connection portion 114 may include a contact component 30. The contact component 30 may have a first portion 31, a second portion 32, and an outer surface 33. The contact component 30 may be a conductive member having a plurality of openings to allow a plurality of electrical contacts, such as second contact 120 and third contact 130, to pass axially through, while also fitting within the parameters of the opening 55 of the connector body 50. The contact component 30 may be disposed within the opening 55 of the connector body 50. Moreover, the contact component 30 may be suspended within the opening 55 of the connector body 50, preserving a general clearance with the connector body 50. In some embodiments, while the contact component 30 is disposed within the opening 55 of the connector body 50, the contact component 30 is suspended by the insert 70 to provide a clearance between the contact component 30 and the connector body 50. In other words, the contact component 30 may not physically or electrically contact the connector body 50. For example, the insert 70, described infra, may be disposed between the contact component 30 and the connector body 50. In one embodiment, the insert 70 may suspend, or otherwise locate the contact component 30 by substantially surrounding the third contact opening 35. In still other embodiments, it should be recognized that the contact component 30 may be a structural feature formed integrally with and included as part of the post 40, so that the included integral contact component portion 30 of the post 40 structurally and functionally operates in a manner consistent with the separate contact component 30 elementarily described herein.

Furthermore, the contact component 30 (or a corresponding feature formed integrally with and included on the post 40) may include a second contact opening 34 proximate or otherwise near a first portion 31, and a third contact opening 35 proximate or otherwise near a second portion 32. The contact component 30 may also be a base section 37 with one or more openings extending therethrough, wherein the one or more openings of the base section 37 of the contact component 30 may have any orientation that may correspond with the structural positioning of the plurality of electrical contacts. The base section 37 of the contact component 30 may be a section of conductive material that includes the first contact opening 34 and the second contact opening 35. Alternatively, the contact component 30 may include a base section 37 which separates the first portion 31 from the second portion 32. One of the second and third contact openings 34, 35 may be larger than the other. For example, the third contact opening 35 may have a larger diameter than the second contact opening 34 to accommodate larger diameter contacts, such as center conductive strand 18*a*, 18*b* of a multi-conductor cable 10, 11. Moreover, the connector 100, 200 may have various non-concentric alignments of the electrical contacts 110, 120, 130, or 210, 220, 230. In one embodiment, the non-concentric alignment of the contacts 110, 120, 130 or 210, 220, 230 may resemble an isosceles triangle. In another embodiment, the non-concentric alignment of the contact 110, 120, 130 or 210, 220, 230 may resemble a right triangle. In yet another embodiment, the non-concentric alignment of the contacts 110, 120, 130 or 210, 220, 230 may be a line configuration. Accordingly, the structure of the contact component 30 may change to accommodate the various alignments of the plurality of electrical contacts, such as contacts 110, 120, 130 or 210, 220, 230.

Because there may be various alignments of the contacts 110, 120, 130, the positioning of the first contact opening 34 and the second contact opening 35 may vary. For example, in one embodiment, the second contact opening 34 and the third contact opening 35 are positioned in a stacked alignment (e.g. top/bottom relationship). In another embodiment, the second contact opening 34 and the third contact opening 35 are positioned in a side-by-side alignment. To achieve various non-concentric alignments of the contacts 110, 120, 130, the structural positions of the connector body 50 and the contact component 30 (e.g. tilt angle of contact component 30, location/angle of opening 55) may have to be correspondingly modified to accommodate different contact 110, 120, 130 positions.

Furthermore, the second contact opening 34 may accept, accommodate, receive, etc. a second contact 120 of connector 100, and may be an opening, a hole, a bore, a tubular pathway, and the like. In most embodiments, the second contact 120 configured to be inserted into the second contact opening 34 extends a continuous electrical path throughout the multi-conductor cable connector 100. The location of the second contact opening 34 may correspond to an alignment of the second contact 120, wherein the second contact 120 shares a non-concentric alignment with the first contact 110 and the third contact 130. The non-concentric alignment of the electrical contacts 110, 120, 130 could be any non-concentric alignment, or may be a non-concentric alignment associated with most multi-conductor cables designs and standards, such as XLR cables and similar multi-conductor cables.

Likewise, the third contact opening 35 of the contact component 30 may accept, accommodate, receive, etc. a third contact 130 of connector 100, and may be an opening, a hole, a bore, a tubular pathway, and the like. In most embodiments, the third contact 130 configured to be inserted into the third contact opening 35 extends a continuous electrical path throughout the multi-conductor cable connector 100. However, the location of the third contact opening 35 may correspond to an alignment of the third contact 130, wherein the third contact 130 shares a non-concentric alignment with the first contact 110 and second contact 120. The non-concentric alignment of the electrical contacts 110, 120, 130 could be any non-concentric alignment, or may be a non-concentric alignment associated with most multi-conductor cables designs and standards, such as XLR cables and similar multi-conductor cables. In most embodiments, the location of the third contact opening 35 corresponds to the location and/or alignment of a center conductive strand 18*a*, 18*b* of a multi-conductor cable 10, 11.

Furthermore, the contact component 30 may include a mating surface 36 which faces the first end 1 of the connector 100. While operably configured, the mating surface 36 may abut, contact, communicate, border, touch, press against, and/or adjacently join with the first edge 43 of the thicker portion 45 of the post 40. Because the post 40 is in physical and electrical contact with the drawn back and exposed first conductive strand layer 14*a*, the physical and electrical contact between the first edge 43 of the post 40 and the mating surface 36 of the contact component 30 establishes and maintains a continuous electrical path between the post 40 and the contact component 30. Thus, a continuous electrical path exists from the first conductive strand layer 14*a* to a second pin 120 positioned within the second pin opening 34, due to the conductive communication between the conductive contact component 30 and the second contact 120. Moreover, manufacture of the contact component 30 may include casting, extruding, cutting, turning, rolling, stamping, photo-etching, laser-cutting, water-jet cutting, and/or other fabrication methods that may provide efficient production of the component.

Referring still to FIG. 3B, embodiments of a cable connection portion 114 of a multi-conductor cable connector 100 may include an insert 70. The insert 70 may have a first end 71, a second end 72, an inner surface 73, and an outer surface 74. The insert 70 may be disposed between the contact component 30 and the connector body 50. Alternatively, the insert 70 may be a sleeve for the contact component 30, in particular, the second portion 32 of the contact component 30. In most embodiments, the insert 70 is radially disposed over the second end 42 of the post 40 without physical contact with the post 40, but substantially surrounding the second portion 32 of the contact component 30. For instance, the insert 70 may be radially disposed over the post 40 from the second end 42 to the first edge 43 of the thicker portion 45, wherein the inner surface 73 of the insert 70 may physically contact the outer surface 33 of the contact component 30. Additionally, the outer surface 73 of the insert 70 may physically contact the inner surface 58 of the connector body 50.

Moreover, the insert 70 may be a substantially annular member. For instance, the insert 70 may have an opening running axially along the insert 70 from the first end 71 to the second end 72. The insert 70 may radially surround a majority of the second portion 32 of the contact component 30 to prevent physical and electrical contact between the contact component 30 and the connector body 50. Additionally, the insert 70 may include an outer annular lip 76 that may mate, engage, touch, abut, contact, or reside substantially close to the internal lip 56 of the connector body 50. The outer annular lip 76 may provide, ensure, support, or compliment a clearance between the connector body 50 and the post 40. Furthermore, the insert 70 should be made of non-conductive, insulator materials. Manufacture of the insert 70 may include casting, extruding, cutting, turning, drilling, compression molding, injection molding, spraying, or other fabrication methods that may provide efficient production of the component.

Additionally, embodiments of a cable connection portion 114 may include a spacer 135. The spacer 135 may be a generally cylindrical member having an outwardly extending flange. The third contact 130 may pass axially through the spacer 135. In other words, the spacer 135 may be radially disposed over the third contact 130, wherein the spacer 135 is also axially disposed within the post 40 proximate or otherwise near the second end of the post 40. The spacer 135 may physically contact the third contact 130, post 40, the contact plate 95, the dielectric 16, the contact component 30, and the connector body 50 to effectuate sufficient tightness, fitting, and/or tolerances between those components. Moreover, the spacer 135 should be made of non-conductive materials, such as an insulating material. Manufacture of the spacer 135 may include casting, extruding, cutting, turning, drilling, compression molding, injection molding, spraying, or other fabrication methods that may provide efficient production of the component.

In one embodiment, one manner in which the cable connection portion 114 may be fastened to a multi-conductor cable 10 may involve compaction of the conductive member 80, for example, by operation of a fastener member 60. For example, once received, or operably inserted into the connector 100, the multi-conductor cable 10 may be securely set into position by compacting and deforming the outer surface 84 of conductive member 80 against the multi-conductor cable 10 thereby affixing the cable into position and sealing the connection. Compaction and deformation of the conductive member 80 may be effectuated by physical compression caused by a fastener member 60, wherein the fastener member 60 constricts and locks the conductive member 80 into place.

As described herein above with respect to the cable connection portion 114 of embodiments of a multi-conductor cable connector 100, similar structural and functional integrity may be maintained for similar component elements of a cable connection portion 214 of embodiments of a multi-conductor cable connector 200. The various component elements of a cable connection portion 114 of a multi-conductor cable connector 100, may be substantially similar in design and operability both separately and as assembled in a corresponding cable connection portion 214 of a multi-conductor cable connector device 200. For instance, if cable connection portion 214 is a compression connector, it may include a post 40, a connector body 50, a conductive member 80, a fastener member 60, an inner sleeve 20, a contact component 30, a separator 70, and a spacer 135, as described supra.

Referring again to FIG. 3B, embodiments of a multi-conductor cable connector 100 may include a multi-contact portion 113. The multi-contact portion 113 may include an outer housing 90, a first contact 110, a second contact 120, and a third contact 130. Multi-contact portion 113 may be any multi-conductor plug, such as an XLR, XLR3, any XLR type plug/cable, phone plug, audio plug, stereo plug, and the like.

Embodiments of a multi-contact portion 113 may include an outer housing 90. The outer housing 90 may have a first end 91, a second end 92, an inner surface 93, and an outer surface 94. The outer housing 90 can have a generally axial opening from the first end 91 to the second end 92. The generally axial opening may be defined by a first inner diameter proximate or otherwise near the first end 91 and a second inner diameter proximate or otherwise near the second end 92 of the outer housing 90. The first inner diameter of the outer housing 90 may be large enough to allow the connector body 50 to pass axially through the first end 91, or dimensioned such that the connector body 50 may reside substantially within the outer housing 90 proximate or otherwise near the first end 91. Moreover, the outer housing 90 may include an internal lip 96 located within the generally axial opening of the outer housing 90. The internal lip 96 may be an annular edge or surface that can define the size difference between the first inner diameter and the second inner diameter. For example, if the outer housing 90 includes an internal lip 96, the second inner diameter of the outer housing 90 will be larger than the first inner diameter of the outer housing 90. The second inner diameter of the outer housing 90 may be large enough to provide sufficient clearance and/or access to the plurality of contacts non-concentrically aligned with the cable connection portion 114. Additionally, a contact plate 95 having a diameter slightly smaller or substantially similar to the second inner diameter of the outer housing 90 may be axially inserted at the second end 92 until it engages with internal lip 96, which prevents further axial movement of the contact plate 95. The contact plate 95 may have a plurality of openings that correspond to the non-concentric alignment of the contacts, such as first contact 110, second contact 120, and third contact 130.

Furthermore, outer housing 90 may include an annular recess 97 located proximate or otherwise near the second end 92. The outer housing 90 may also include a tapered surface 98 which resides proximate or otherwise near the outer annular recess 97. The combination of the annular recess 97 and the second inner diameter may lead a smaller thickness proximate or otherwise near the second end 92 than the thickness proximate the first end 91. Moreover, an opening 99, 199 may be located on the outer rim of the outer housing 90 proximate or otherwise near the second end 92. The opening 99 may accept, receive, engage, interact with a shaft-like spline 299 to ensure that the male multi-conductor cable connector 101 twists, moves, rotates, etc. with a female multi-conductor cable connector 102 when movement occurs. The opening 99, 199 may be a notch, groove, channel, and the like. Additionally, the outer housing 90 may be located proximate or otherwise near the second end 2 of the multi-conductor cable 100. Specifically, the outer housing 90 may be disposed over a portion of the connector body 50 and contact plate 95. Thus, a portion of the first, second, and third contacts 110, 120, 130 may be located within the general axial opening of the outer housing 90, while the remaining portion of the contacts 110, 120, 130 may enter the cable connection portion 114. The outer housing 90 may be formed of conductive or non-conductive materials, or a combination of conductive and non-conductive materials. For example the outer or external surface 94 of the outer housing 90 may be formed of a polymer, while the remainder of the outer housing 90 may be comprised of a metal or other conductive material. Moreover, the outer housing 90 does not have to be in electrical communication or contact with the outermost conductor, such as the second conductive strand layer 14*b*. For instance, the outer housing 90 may be made of non-conductive material(s) without preventing the operation of the electrical paths through the connector 100, 200. The outer housing 90 may be formed of metals or polymers or other materials that would facilitate a rigidly formed housing 90. Embodiments of outer housing 90 may be a male outer housing 190 or a female outer housing 290. The male outer housing 190 may be substantially similar to the structure and function of embodiments of outer housing 90 described supra.

Figure 4:
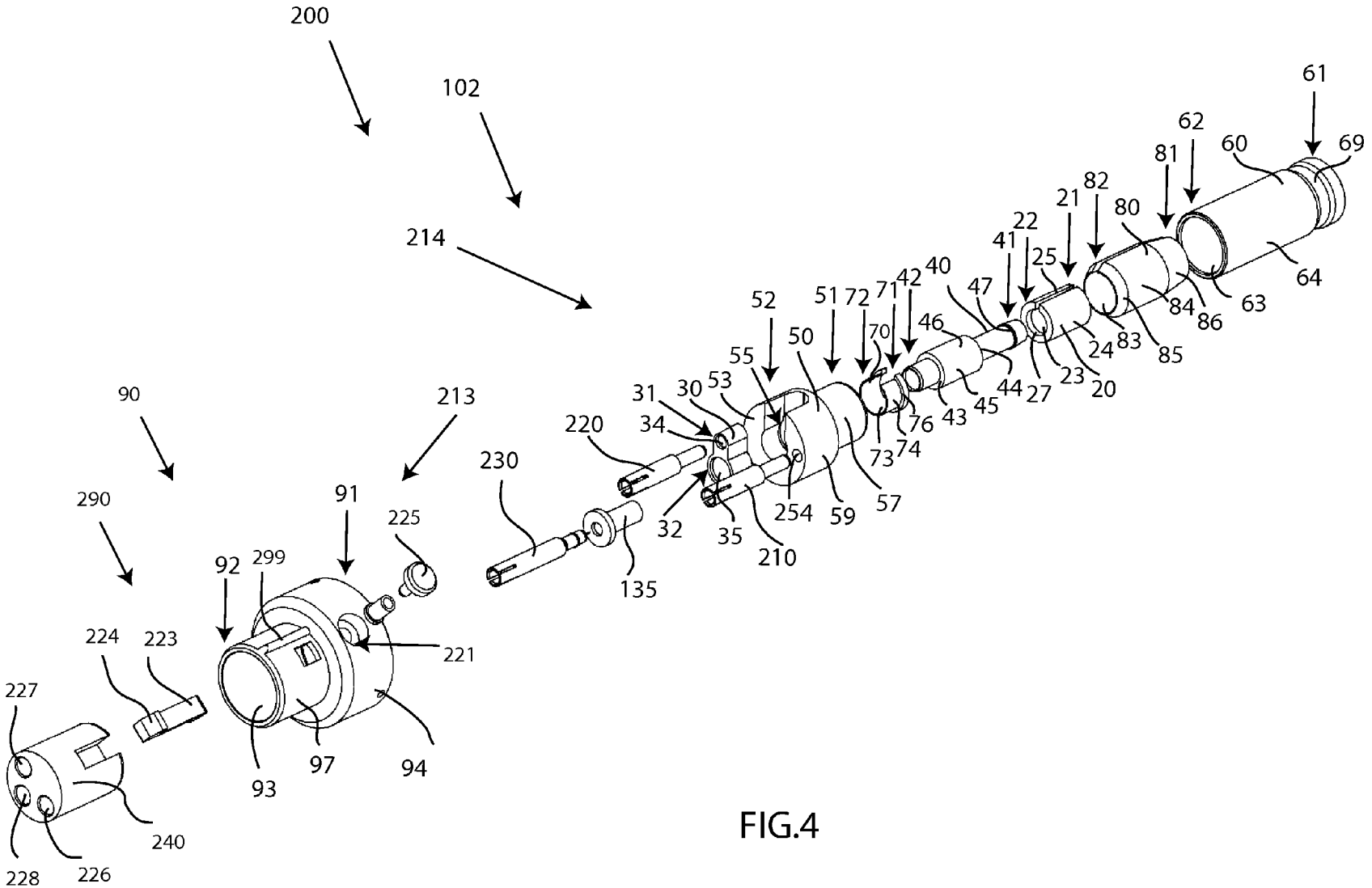
FIG. 4 depicts an exploded perspective view of the second embodiment of the multi-conductor cable connector.

Referring now to FIGS. 4-5B, an embodiment of a multi-conductor cable connector 200 is depicted. The multi-conductor cable connector embodiment 200 may have several similar features with a multi-conductor cable connector embodiment 100. However, the embodiment of a multi-conductor cable connector 200 may be a female connector 102. As such, the multi-conductor cable connector 200 may include a female outer housing 290. Embodiments of a female outer housing 290 may share some structure and function of the outer housing 90, but may include additional or different structural and/or functional aspects. For instance, the female outer housing 290 may include a spline 299 located on the outer surface 294 of the female outer housing 290 to ensure cohesive and concurrent movement between the male and the female connector 101, 102. The female outer housing 290 may also include a contact receiver 210, and a securing means 221. The contact receiver 240 may include a plurality of openings that may accept, accommodate, receive, support, and/or guide a plurality of contacts, such as the first, second, and third contacts 110, 120, 130. In most embodiments, the plurality of openings may include a first receptive contact opening 226, which corresponds to the first contact 110, a second receptive contact opening 227, which corresponds to the second contact 120, and a third receptive contact opening 228 which corresponds to the third contact 130. The orientation of the first, second, and third receptive contact openings 226, 227, 228 may correspond to the non-concentric alignment of the contacts 110, 120, 130. The contact receiver 220 may be positioned within or substantially within the female outer housing 290 proximate a second end 292. In other words, the female outer housing 290 may surround or substantially surround the contact receiver 240. In one embodiment, the contact receiver 240 fits snugly within the female outer housing 290. The contact receiver 240 should be formed of non-conductive materials, such as rubber or other polymeric material. Manufacture of the contact receiver 240 may include casting, extruding, cutting, turning, drilling, compression molding, injection molding, spraying, or other fabrication methods that may provide efficient production of the component.

Furthermore, embodiments of the female outer housing 290 may include a securing means 221. Securing means 221 may be any other securing means operable with a multi-conductor cable connector. Securing means 221 may be a latching mechanism having a latch arm 223 and latch head 224. Embodiments of latch head 224 may have a ramped surface(s) to releasably engage the male outer housing 190. A lock button 225 may be operably associated with the latch arm 223 and latch head 224 to releasably secure the male multi-conductor cable connector 101 to the female multi-conductor cable connector 102. The lock button 225 may be exposed and/or accessible on the outer surface 294 of the female outer housing 290. Those skilled in the art should appreciate that securing means 221 may be a variety of securing means typically associated with multi-conductor cables, such as XLR type cables.

Referring back to FIGS. 3B and 3C, embodiments of a multi-contact portion 113 may include a first contact 110, a second contact 120, and a third contact 130. Alternative embodiments of multi-contact portion 113 may have less than three electrical contacts, such as a connector having two electrical contacts. In yet another embodiment, the multi-contact portion 113 may have more than three conductors, such as a connector having four electrical contacts. A contact may be a conductive element that may extend or carry an electrical current and/or signal from a first point to a second point. A contact may be a terminal, a pin, a conductor, an electrical contact, and the like. Contacts 110, 120, 130 may have various diameters, sizes, and may be arranged in any non-concentric alignment throughout the connector 100. Furthermore, a contact, such as the first, second, and third contacts 110, 120, 130 may be hermaphroditic. In other words, the contacts 110, 120, 130 may both female and male. The male electrical contacts may include spikes, or similar pointed protrusion, which may be configured to insert into the center conductive strand 18*a*, as depicted in FIG. 6B. In contrast, the female electrical contact may include sockets, or similar receptacle, which may be configured to receive an exposed, protruding center conductive strand 18*b*, as depicted in FIG. 8B. Thus, electrical contacts which are hermaphroditic may include a socket element at one end to receive, and a spike element at the opposing end. Furthermore, a first contact 110 may extend a continuous electrical ground path through the connector 100. In one embodiment, a first end, or portion, of the first contact 110 may be positioned within the first contact opening 54 of the connector body 50 of the male connector 101, and a second end, or portion, may be inserted into the first receptive contact opening 226 of the female connector 102. A second contact 120 may extend a continuous electrical path through the connector 100. In one embodiment, a first end, or portion, of the second contact 120 may be positioned within the second contact opening 34 of the contact component 30 of the male connector 101, and a second end, or portion, may be inserted into the second receptive contact opening 227 of the female connector 102. Moreover, a third contact 130 may extend a continuous electrical path through the connector 100. In one embodiment, a first end, or portion, of the third contact 130 may be inserted through the third contact opening 35 of the contact component 30 of the male connector 101, and a second end, or portion, may be inserted into the third receptive contact opening 228 of the female connector 102.

Figure 6A:
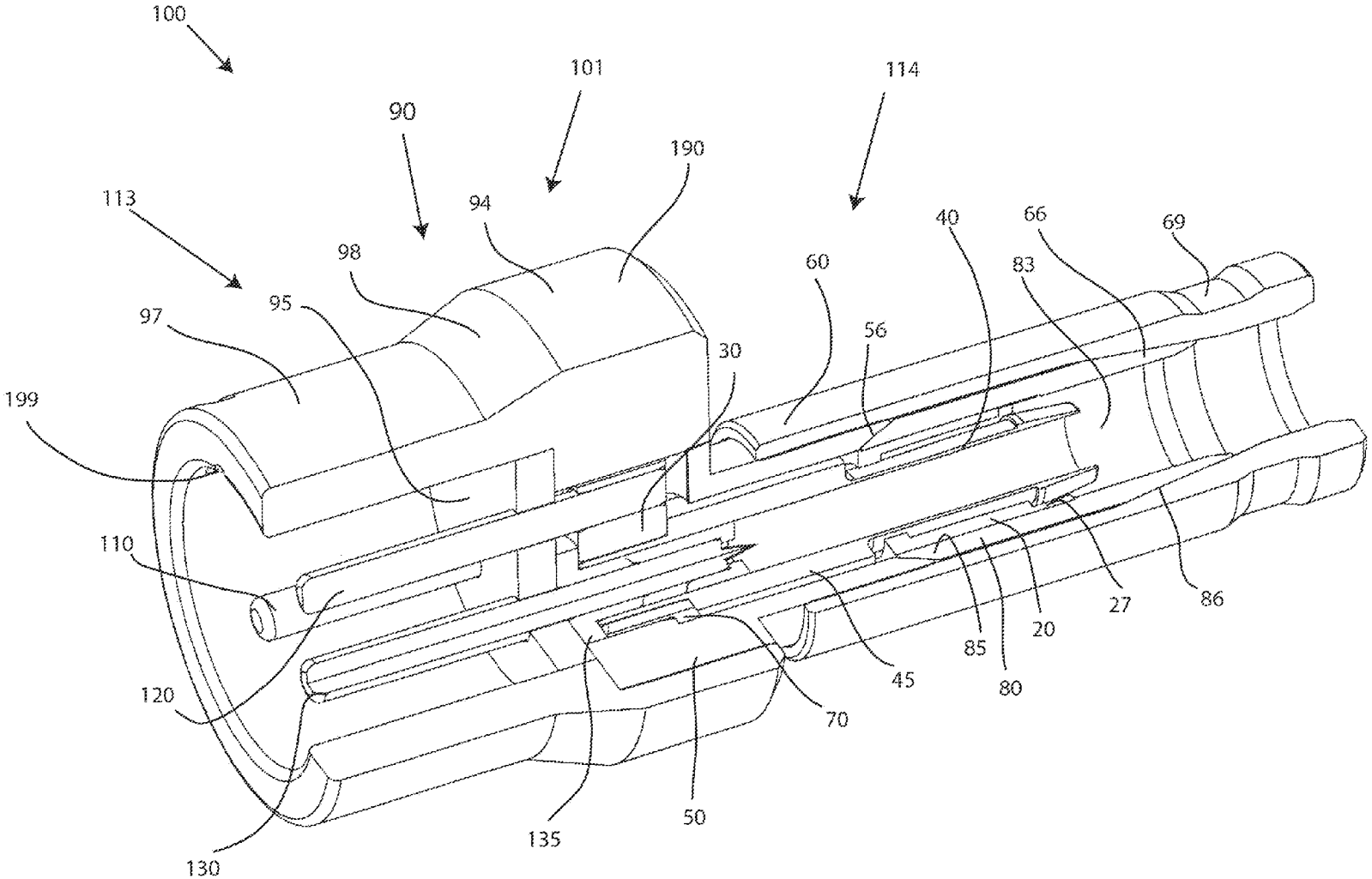
FIG. 6A depicts a perspective cut-away view of the first embodiment of the multi-conductor cable connector.
Figure 6B:
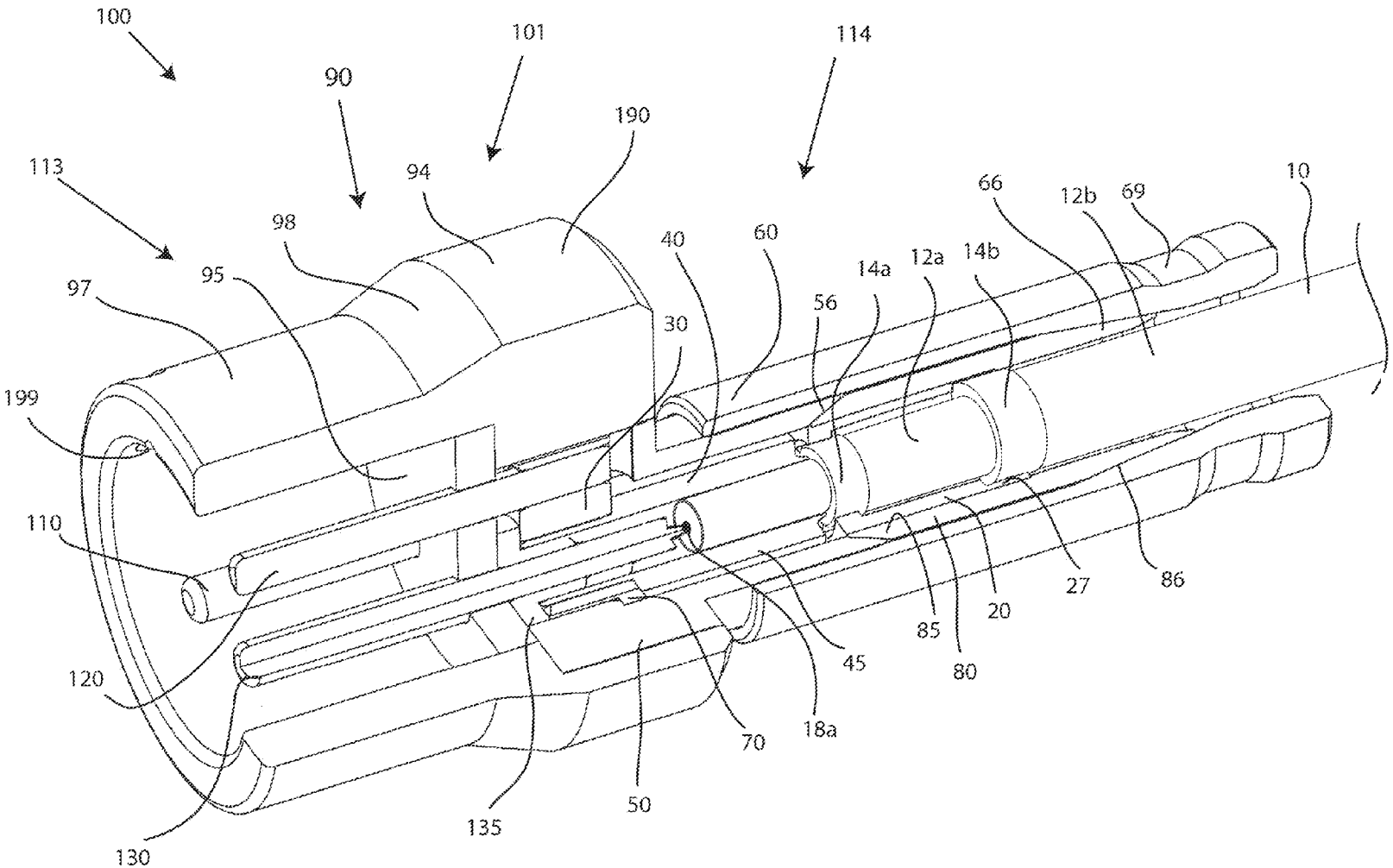
FIG. 6B depicts a perspective cut-away view of the first embodiment of the multi-conductor cable connector having an attached multi-conductor cable.

With continued reference to the drawings, FIGS. 6A and 6B depicts an embodiment of a multi-conductor cable connector 100 which includes a multi-contact portion 113 and a cable connection portion 114. Coupling the cable connection portion 114 with the multi-conductor multi-contact portion 113 may provide a plurality of electrical paths through the connector 100 while avoiding the hassles and dangers of soldering separate wires associated with the conductors. For example, the cable connection portion 114 involves straightforward cable 10 preparation (e.g. drawings back outer jackets 12*a*, 12*b*, etc.) instead of soldering methods, saving time during installation, while also achieving high strength, low stress bonding to the contacts 110, 120, 130 of the connector 100. Furthermore, the multi-conductor multi-contact portion 113 non-concentrically aligned with the cable connection portion 114 reduces the possibility of mis-wiring the contacts of the connector 100 because the order of termination of the contacts, such that the first, second, and third contacts 110, 120, 130, are "hard-wired" into the cable connection portion 114 (i.e. no need to spend time repeatedly executing precautionary steps to avoid mistakes while soldering).

Figure 7:
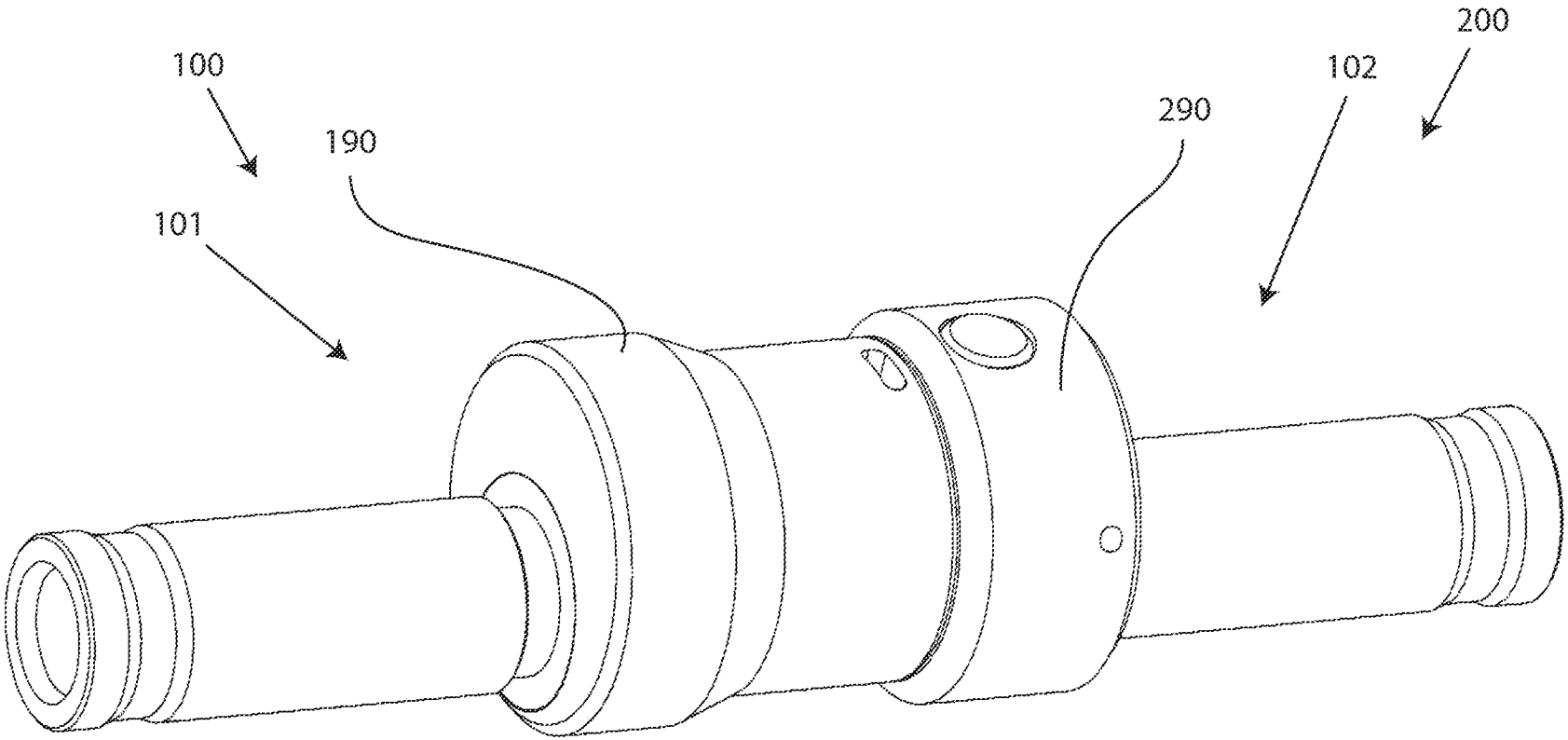
FIG. 7 depicts a perspective view of the first embodiment of the multi-conductor cable connector in a mated position with the second embodiment of the multi-conductor cable connector.

The electrical paths throughout the connector 100, 200 are now further described with reference to FIG. 6B. A first electrical path or electrical ground path may be associated with the first contact 110. The multi-conductor cable 10 may include a second conductive strand layer 14*b* that carries an electrical current or signal, and may be drawn back and exposed, as depicted in FIG. 2. While operably configured, the conductive member 80, in particular, the inner surface 83, physically and electrically contacts the second conductive strand layer 14*b* to extend a continuous electrical ground path between them. The conductive member 80 physically and electrically contacts the connector body 50 to extend a continuous electrical ground path between them. Moreover, an end of the first contact 110 physically and electrically contacts the connector body 50 while inserted into the first contact opening 54. While in a mated position, as depicted in FIG. 7, the first contact 110 of a male connector 101 may be received by the first receptive contact opening 226 of the contact receiver 220 of a female connector 102, extending a continuous electrical ground path therebetween.

Figure 13:
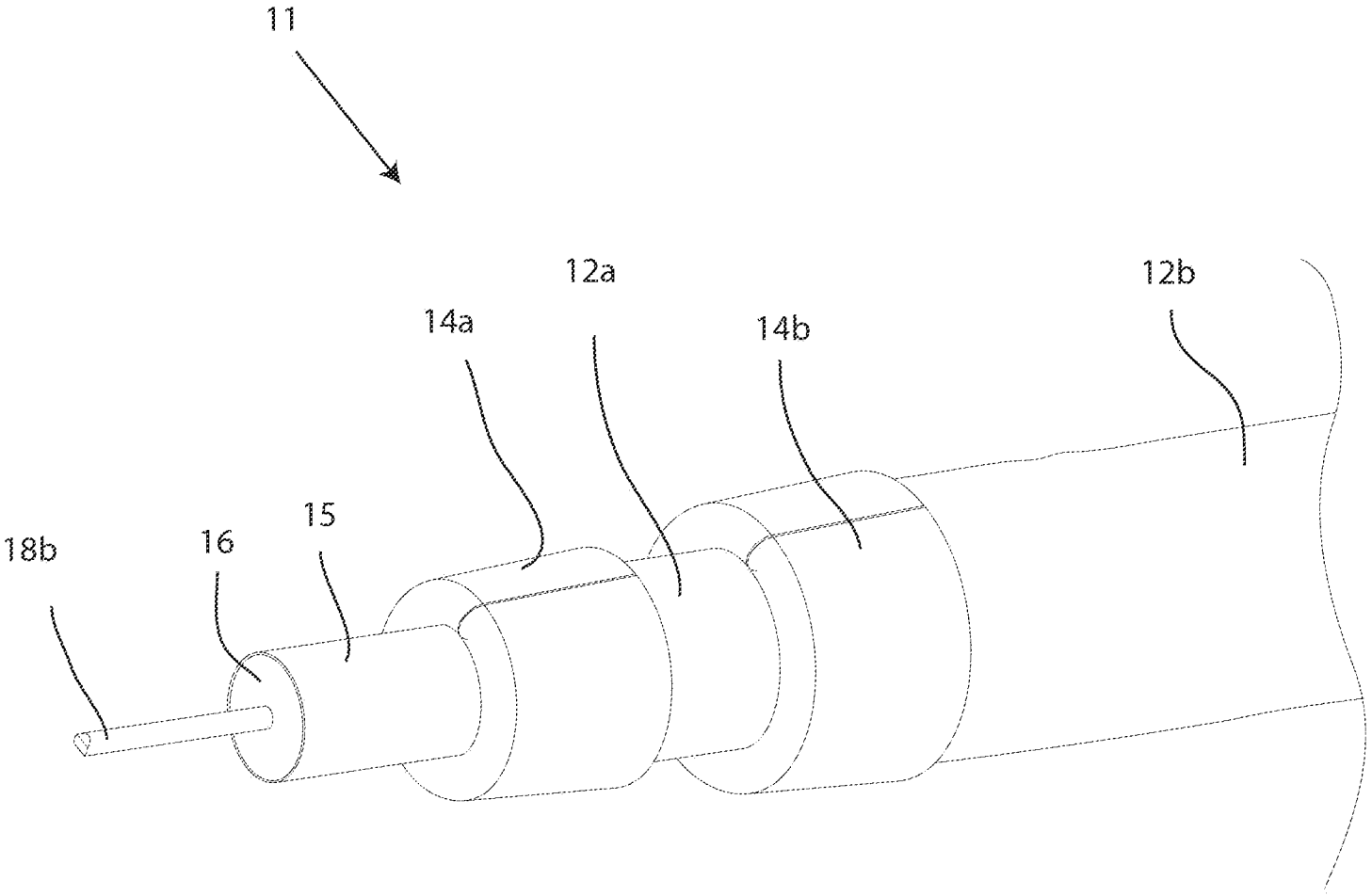
FIG. 13 depicts a perspective view of a second embodiment of a multi-conductor cable having a plurality of conductive strands concentrically sharing a common central axis.

A second electrical path through the connector 100 may be associated with a second contact 120. The multi-conductor cable 10, 11 may include a first conductive strand layer 14*a*, which carries an electrical current or signal, and may be drawn back and exposed, as depicted in FIGS. 2 and 13. While operably configured, the post 40, in particular, the outer surface 46, physically and electrically contacts the first conductive strand layer 14*a* to extend a continuous electrical path between them. The post 40 physically and electrically contacts the contact component 30 to extend a continuous electrical path between them. Moreover, an end of the second contact 120 physically and electrically contacts the contact component while inserted into the second contact opening 34 of the contact component 30. While in a mated position, as depicted in FIG. 7, the second contact 120 of a male connector 101 may be received by the second receptive contact opening 227 of the contact receiver 240 of a female connector 102, extending a continuous electrical path therebetween.

A third electrical path through the connector 100 may be associated with a third contact 130. The multi-conductor cable 10, 11 may include a center conductive strand 18*a*, 18*b*, which carries an electrical current or signal. An end of the third contact 130 physically and electrically contacts the center conductive strand 18*a*, 18*b*. In one embodiment, a spike engages, pierces, pokes, etc., or pushes into the center conductive strand 18*a*. In another embodiment, a socket element receives the center conductive strand 18*b*, as depicted in FIG. 13. While in a mated position, as depicted in FIG. 7, the third contact 130 of a male connector 101 may be received by the third receptive contact opening 228 of the contact receiver 220 of a female connector 102, extending a continuous electrical path therebetween.

Figure 8A:
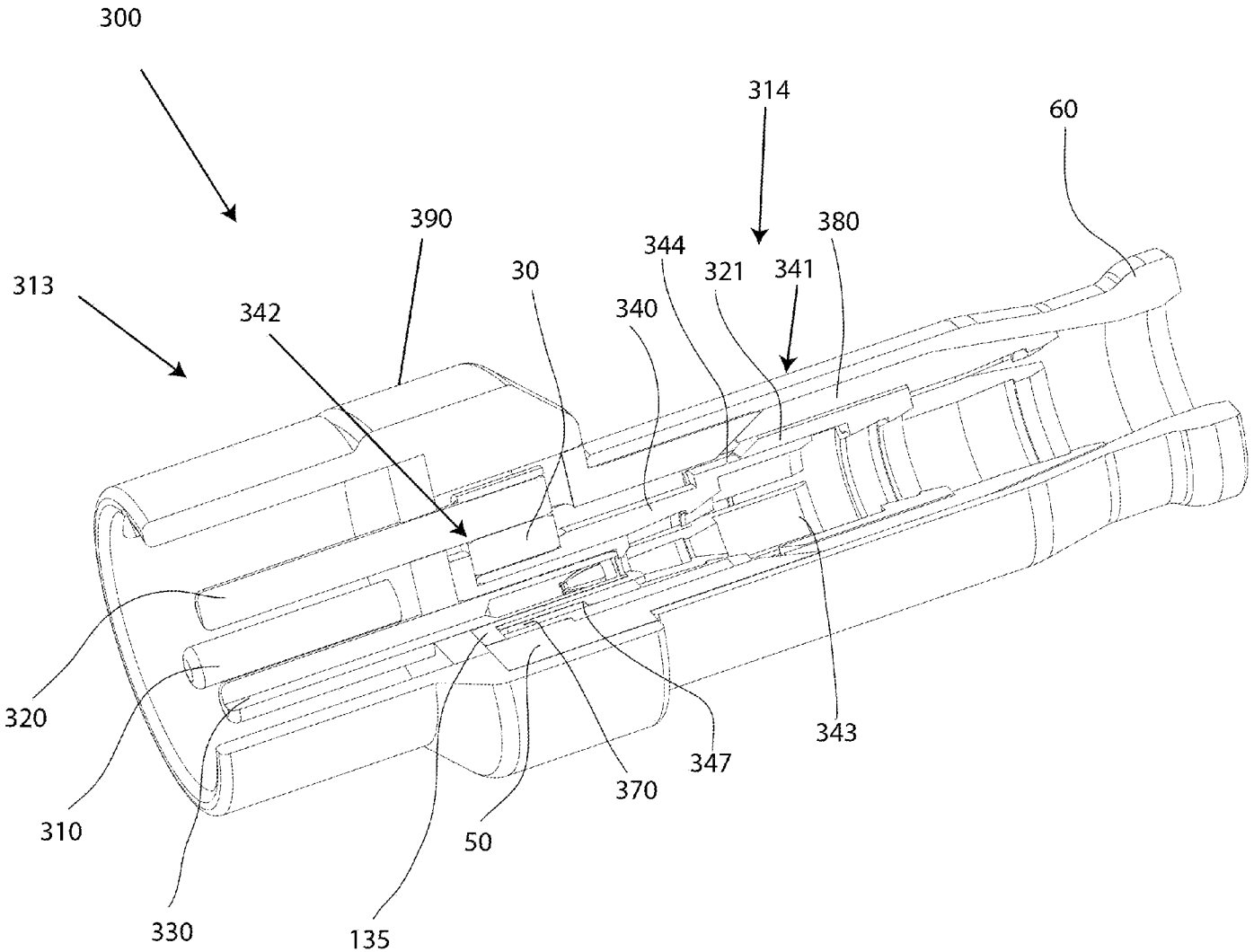
FIG. 8A depicts a perspective cut-away view of a third embodiment of the multi-conductor cable connector.
Figure 8B:
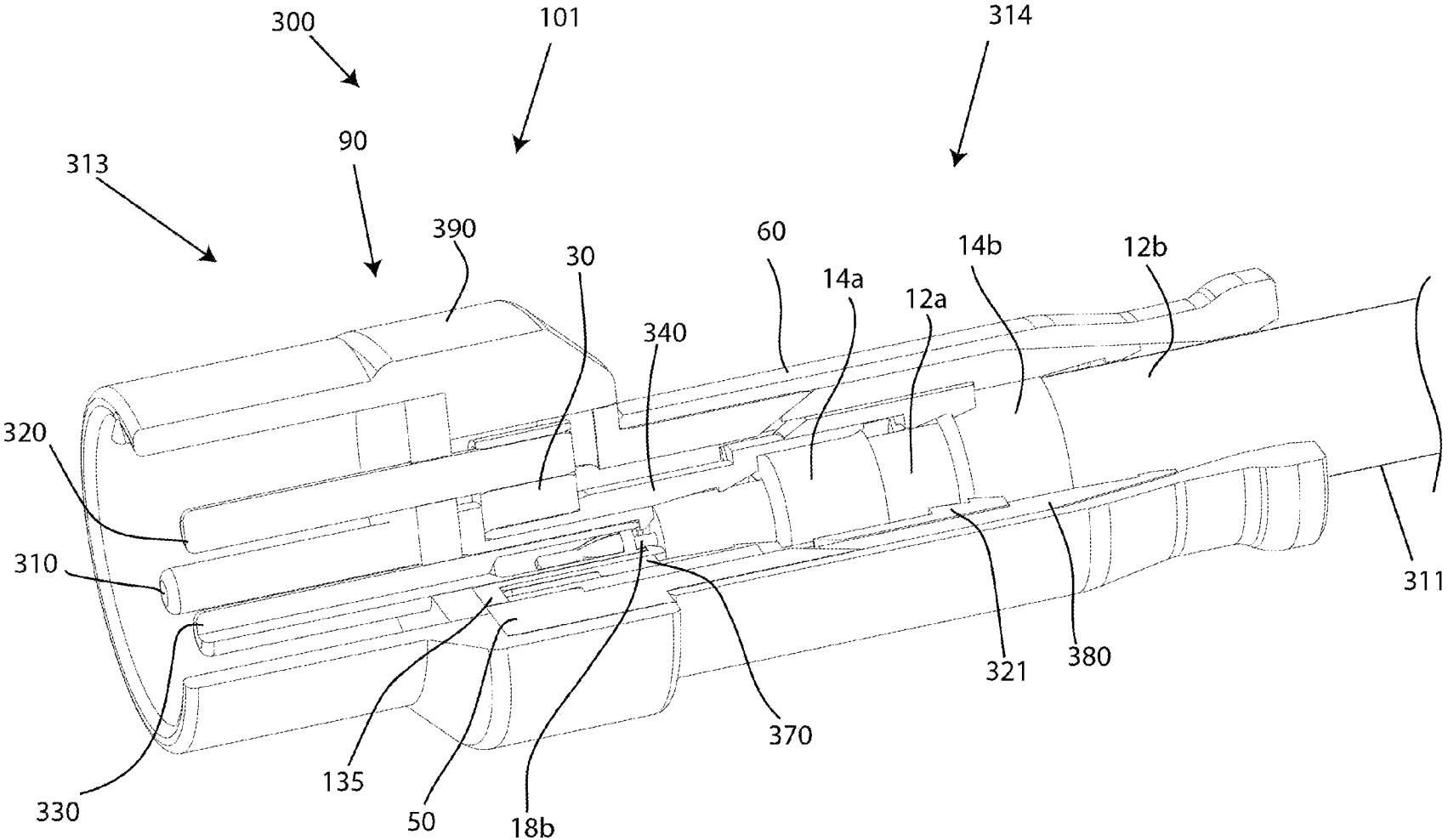
FIG. 8B depicts a perspective cut-away view of the third embodiment of the multi-conductor cable connector having an attached multi-conductor cable.

Referring still to the drawings, FIGS. 8A-8B depict an embodiment of a multi-conductor cable connector 300. Multi-conductor cable connector 300 may include a cable connection portion 314 and multi-contact portion 313. Embodiments of cable connection portion 314 may receive a plurality of conductive strands configured to communicate with a plurality of electrical contacts, such as contacts 110, 120, 130. Alternatively, cable connection portion 314 may be configured to receive a prepared multi-conductor cable 10, 11 as described supra, and may include a fastener member 60, a connector body 50, an insert 370, an inner sleeve 321, a contact component 30 and a conductive member 380. Embodiments of the fastener member 60, the connector body 50, the insert 370, the inner sleeve 321, the contact component 30, and a conductive member 380 may be similar or substantially similar to the structure and function as provided for the embodiments associated with connector 100, 200.

However, connector 300 may also include a continuity element 340 instead of, as a substitute for, or a modified version of a post 40 to effectuate multiple electrical paths through connector 300. The continuity element 340 may be a generally annular member having a first end 341, a second end 342, an inner surface 343, and an outer surface 344. Proximate or otherwise near the second end 342, the continuity element 340 may have an annular detent 347. The contact component 30 may generally be positioned proximate the continuity element 340 along the annular detent 347. In some embodiments, an outer surface 344 of the continuity element 340 may physically contact the contact component 30. For instance, the contact component 30 may be disposed about the continuity element 340. Moreover, the continuity element 340 may physically and electrically contact the first conductive strand layer 14*a* which establishes and maintains a continuous electrical path through the connector 300, for example, through the second contact 320. Proximate or otherwise near the first end 341, the continuity element 340 may have a larger diameter to accommodate the expanded diameter of the received cable 10, 11, particularly where the first protective outer jacket 12*a* and first conductive strand layer 14*a* are drawn back to expose the first conductive strand layer 14*a*. Thus, the inner surface 343 of the larger diameter portion of the continuity element 340 may electrically and physically contact the first conductive strand layer 14*a*. The continuity element 340 may also have a tapered surface 348, or ramped surface, annularly extending on the inner surface 343.

In an alternative embodiment, the continuity element 340 may slotted to provide resiliency to the continuity element 340. The continuity element 340 may include a plurality of openings laterally extending from the second end 342 to the first end 341 of the continuity element 340 to provide resiliency to the continuity element 340. When the inner surface 343 proximate or otherwise near the first end 341 engages, touches, communicates, grabs, presses against, etc. the first conductive strand layers 14*a* and extend an continuous electrical path through the connector 300, the continuity element 340, or the fingers separated by the slots/openings will outwardly expand. The resilient nature of the continuity element 340 upon outward expansion from the radially outward forces from the received cable 10, 11, in particular, the first conductive strand layer 14*a* a may result in an opposing, constant inward force. Accordingly, the physical and electrical contact between the continuity element 340 and the first conductive strand layer 14*a* is enhanced, established, and/or maintained during operation of connector 300. Furthermore, the continuity element 340 may be formed of metals or other conductive materials that would facilitate a rigidly formed body, or slotted body. In addition, the continuity element 340 may be formed of a combination of both conductive and non-conductive materials. For example, a metal coating or layer may be applied to a polymer of other non-conductive material. Manufacture of the continuity element 340 may include casting, extruding, cutting, turning, drilling, knurling, injection molding, spraying, blow molding, component overmolding, or other fabrication methods that may provide efficient production of the component.

Furthermore, embodiments of the multi-conductor cable connector 300 may also include a multi-contact portion 313. The multi-contact portion 313 may include an outer housing 390, a first contact 310, a second contact 320, and a third contact 330. Multi-contact portion 313 may be any multi-conductor plug, such as an XLR, XLR3, any XLR type plug/cable, phone plug, audio plug, stereo plug, and the like. Embodiments of the outer housing 390, the first contact 310, the second contact 320, and the third contact 330 may have the similar or substantially similar structural features and functions as provided with the embodiments associated with connector 100, 200.

Figure 9:
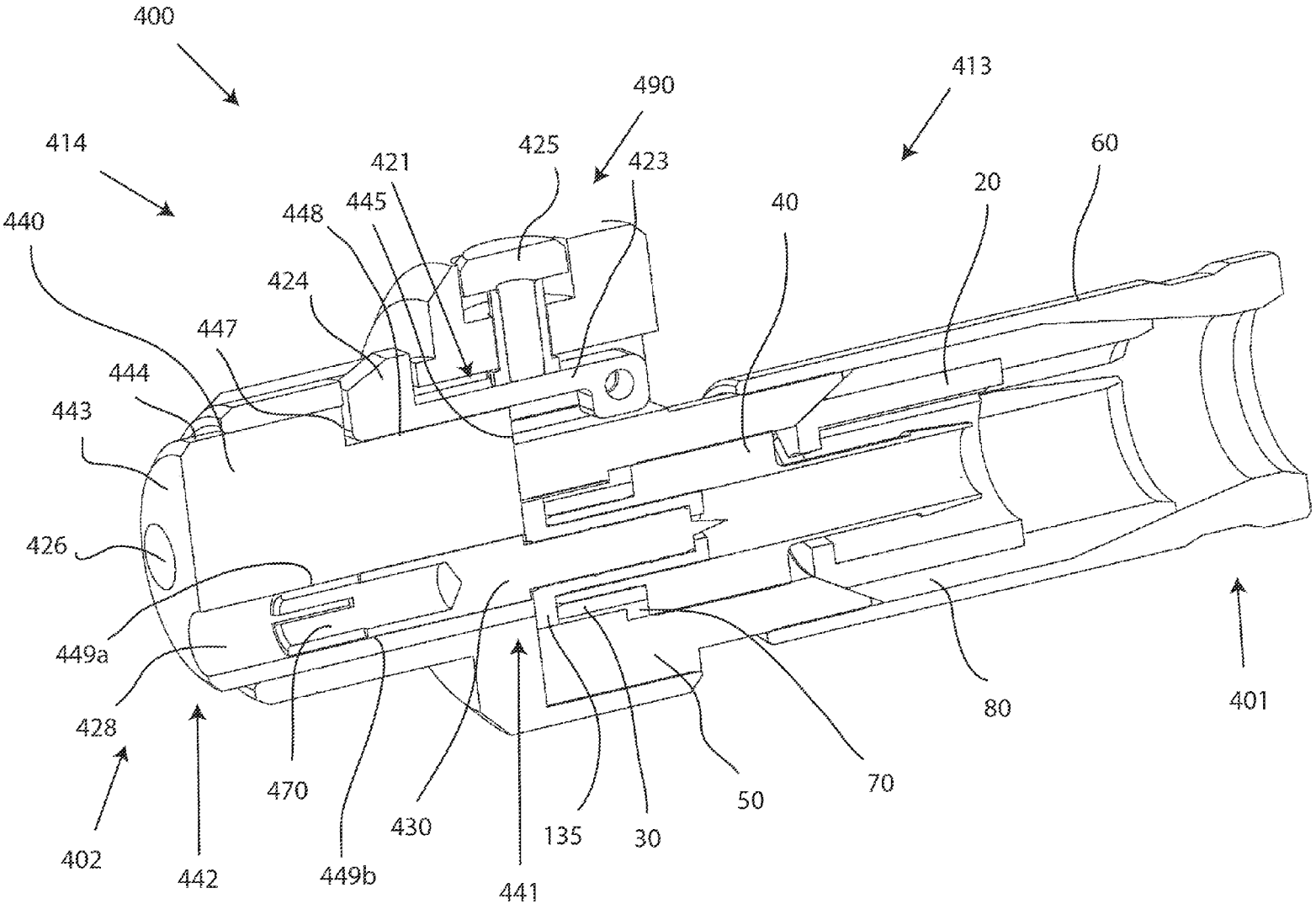
FIG. 9 depicts a perspective cut-away view of a fourth embodiment of the multi-conductor cable connector.
Figure 10:
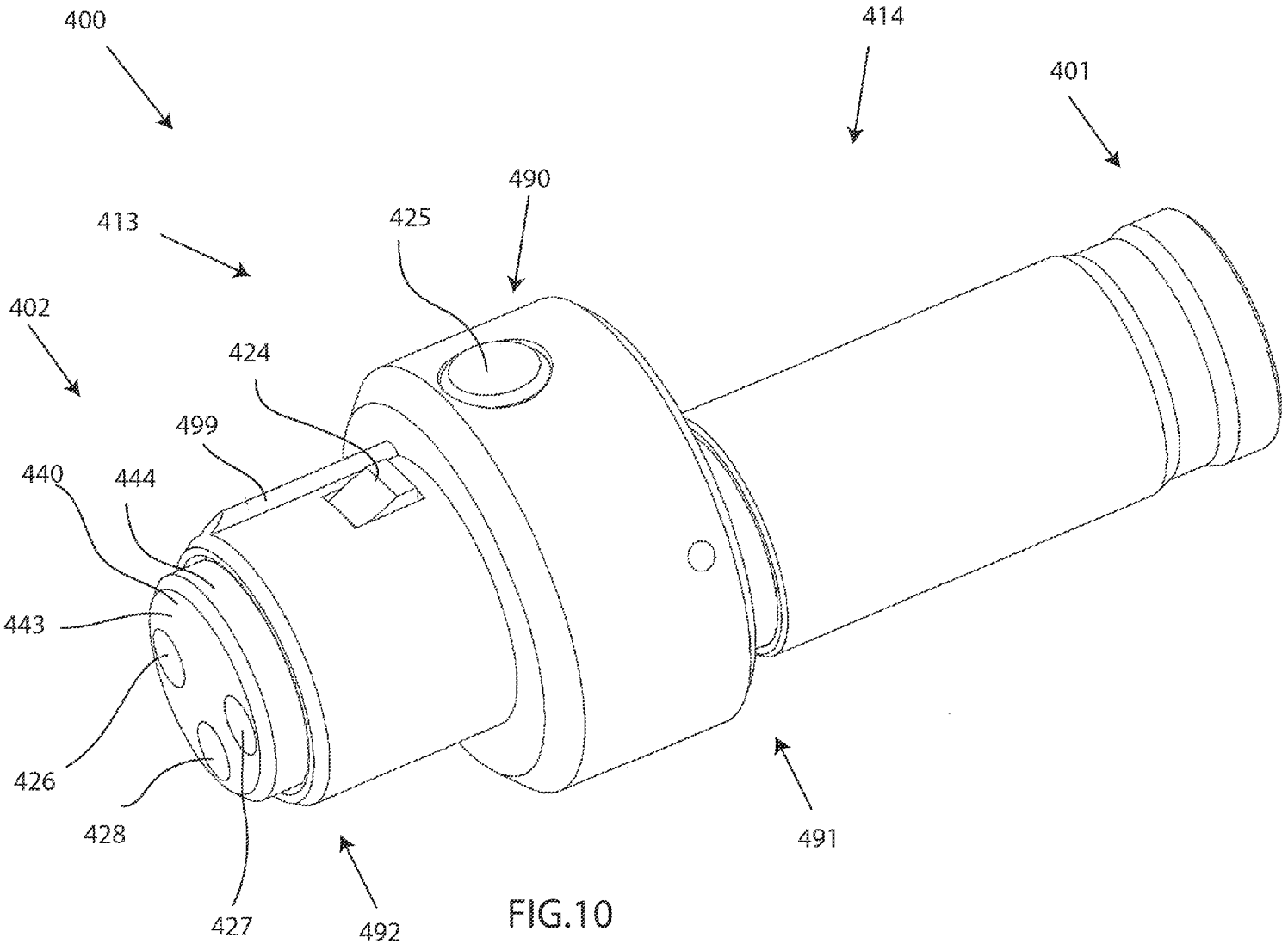
FIG. 10 depicts a perspective view of the fourth embodiment of the multi-conductor cable connector.
Figure 11:
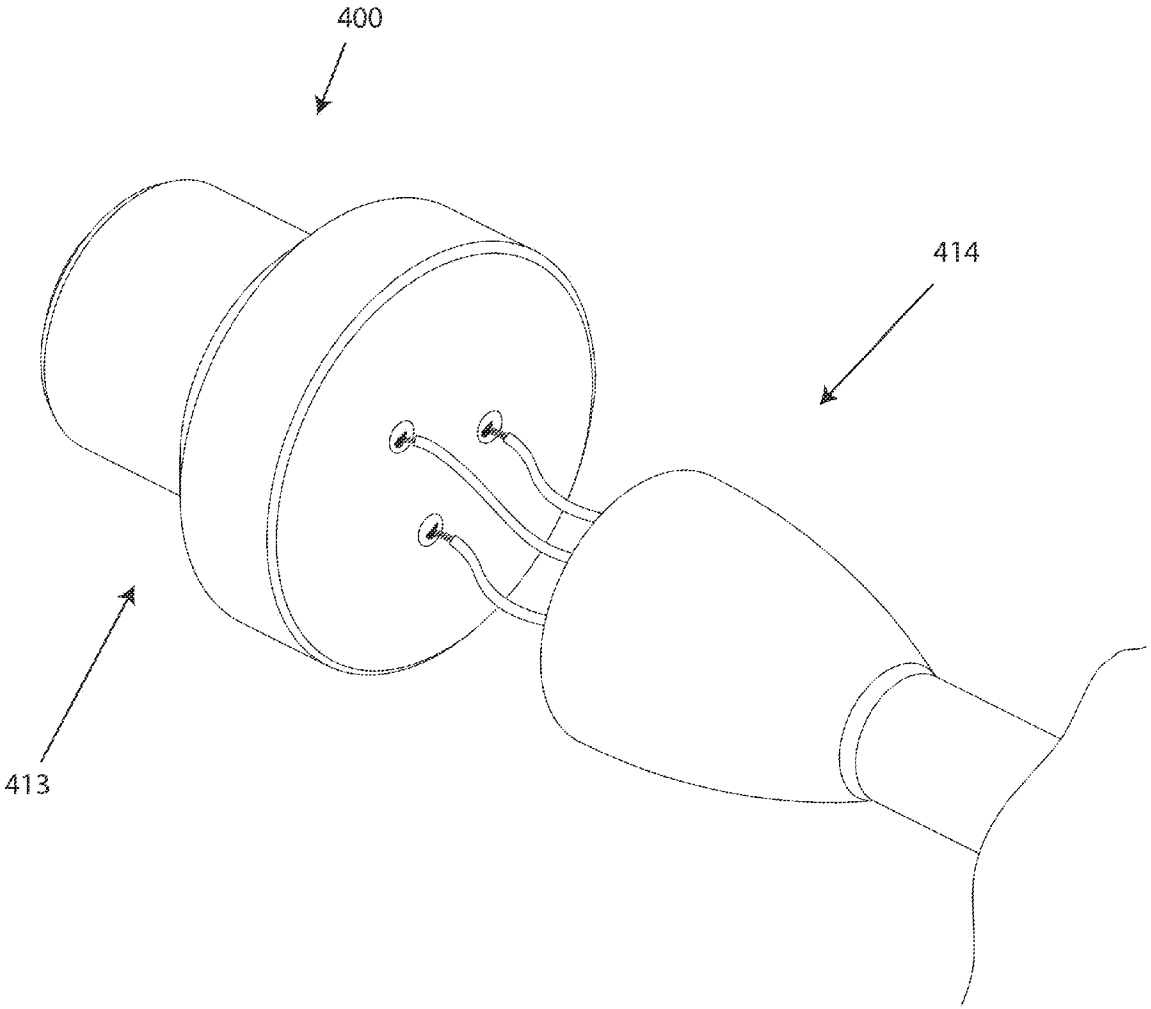
FIG. 11 depicts a schematic view of the fourth embodiment of a multi-conductor cable connector, wherein a cable connection portion is a soldered connection.

Referring now to FIGS. 9 and 10, an embodiment of a multi-conductor cable connector 400 may include a cable connection portion 414 and multi-contact portion 413. Those skilled in the art should appreciate that multi-contact portion 413 may be coupled with a soldered, or other non compression-type cable connection end, other than cable connection portion 414. Specifically, embodiments of a cable connection portion 414 of multi-conductor cable connector 300 may be various cable connector configurations. For example, the cable connection portion 414 may be a soldered connection, welded connection, overmold configuration, crimped connection, compression connector, and the like. Cable connection portion 414 may receive a plurality of conductive strands, wherein a plurality of electrical contacts 110, 120, 130 are in communication (e.g. electrical and/or mechanical contact) with the plurality of conductive strands being received by the cable connection portion 314. FIG. 11 depicts an embodiment of cable connection portion 414 being a soldered connection, wherein a plurality of conductive strands can be soldered to a plurality of electrical contacts 110, 120, 130 associated with the connector engagement portion 413. Therefore, connector engagement portion 413 may be coupled to cable connection 414, wherein the cable connection portion 414 may be a compression connector, a soldered connection, overmold configuration, crimped connection, welded connection, or other cable connector configurations.

In an embodiment where the cable connection portion 414 is a compression connector, it may receive a prepared multi-conductor cable 10, 11 as described supra, and may include a fastener member 60, a connector body 50, an insert 70, an inner sleeve 21, a contact component 30 and a conductive member 80. Embodiments of the fastener member 60, the connector body 50, the insert 70, the inner sleeve 21, the contact component 30, and a conductive member 80 may be similar or substantially similar to the structure and function as provided for the embodiments associated with connector 100, 200, 300.

Embodiments of a multi-conductor cable connector 400, more specifically, embodiments of a multi-contact portion 413 may include a contact receiver 440, having a first end 441 and a second end 442, disposed substantially within an outer housing 490 of a multi-conductor cable connector 400, wherein a portion of the contact receiver 440 extends an axial distance beyond the outer housing 490, and a plurality of openings configured to receive a plurality of electrical contacts 110, 120, 130, the plurality of openings being surrounded by the contact receiver 440, wherein axial compression of the contact receiver 440 establishes and maintains firm electrical and physical contact with the received electrical contacts 110, 120, 130. In another embodiment, a multi-conductor cable connector 400 may include an elastomeric member 440 positioned substantially within an outer housing 490 of a multi-contact portion 413 of the multi-conductor cable connector 400, wherein a portion of the elastomeric member 440 protrudes from the outer housing 490, the elastomeric member 440 surrounding a plurality of electrical contacts 110, 120, 130 each having a socket 470, wherein, when in a mated position, the elastomeric member 440 is axially compressed and radially expands inward to bias the plurality of electrical contacts 110, 120, 130. In yet another embodiment, a multi-conductor 400 may include a cable connection portion 414 including a post 40, configured for receiving a prepared portion of a multi-conductor cable 10, 11, a conductive member 80 radially disposed over the post 40, wherein the conductive member 80 has a first end 81 and a second end 82, and a connector body 50 physically and electrically contacting the conductive member 80 proximate the second end 82 of the conductive member 80, and a multi-contact portion 413 including an outer housing 490 disposed over the connector body 50, a contact receiver 440 having a first end 441 and a second end 442, the contact receiver 440 positioned substantially within the outer housing 490, wherein a portion of the contact receiver 440 proximate the second end 442 axially protrudes a distance beyond the outer housing 490, wherein the connector 400 further includes a plurality of electrical contacts 110, 120, 130 configured to engage with the cable connection portion 414. In a further embodiment, a multi-conductor cable connector 400 may include a cable connection portion 414, wherein the cable connection portion 414 receives a plurality of conductive strands. Alternatively, the cable connection portion 414 may receive a prepared multi-conductor cable 10, 11 having a plurality of conductive strands 14*a*, 14*b* concentrically sharing a common central axis. The cable connection portion 414 may be coupled to a multi-contact portion 413, the multi-contact portion 413 having a plurality of contacts 110, 120, 130 with the cable connection portion 414, and means for establishing and maintaining electrical and physical contact with the received electrical contacts 110, 120, 130 and biasing the latch arm 423 of the securing mechanism 421.

Furthermore, embodiments of a multi-conductor cable connector 400 may have several similar features with a multi-conductor cable connector embodiment 200. For example, multi-conductor cable connector 400 may be a female multi-conductor cable connector, similar to connector 200. As such, the multi-conductor cable connector 400 may include a female outer housing 490. Embodiments of a female outer housing 490 may share some structure and function of the outer housing 90, 290, but may include additional or different structural and/or functional aspects. For instance, the outer housing 490 may have a first end 491, a second end 492, an inner surface 493, and an outer surface 494. The outer housing 490 can have a generally axial opening from the first end 491 to the second end 492. The generally axial opening may be defined by a first inner diameter proximate or otherwise near the first end 491 and a second inner diameter proximate or otherwise near the second end 492 of the outer housing 490. The first inner diameter of the outer housing 490 may be large enough to allow the connector body 50 to pass axially through the first end 491, or dimensioned such that the connector body 50 may reside substantially within the outer housing 490 proximate or otherwise near the first end 491. The second inner diameter of the outer housing 490 may be large enough to provide sufficient clearance and/or access to the plurality of contacts 110, 120, 130 non-concentrically aligned with the cable connection portion 414.

Moreover, outer housing 490 may include an annular recess 497 located proximate or otherwise near the second end 492. The outer housing 490 may be located proximate or otherwise near the second end 402 of the multi-conductor cable 400. Specifically, the outer housing 490 may be disposed over a portion of the connector body 50. Thus, a portion of the first, second, and third contacts 110, 120, 130 may be located within the general axial opening of the outer housing 490, while the remaining portion of the contacts 110, 120, 130 may enter the cable connection portion 414. The outer housing 490 may be formed of conductive or non-conductive materials, or a combination of conductive and non-conductive materials. For example the outer or external surface 494 of the outer housing 490 may be formed of a polymer, while the remainder of the outer housing 490 may be comprised of a metal or other conductive material. Moreover, the outer housing 490 does not have to be in electrical communication or contact with the outermost conductor, such as the second conductive strand layer 14*b*. For instance, the outer housing 490 may be made of non-conductive material(s) without preventing the operation of the electrical paths through the connector 400. The outer housing 490 may be formed of metals or polymers or other materials that would facilitate a rigidly formed housing 490. The outer housing 490, with respect to a female type multi-conductor cable 400, may include a spline 499 located on the outer surface 494 of the female outer housing 490 to ensure cohesive and concurrent movement between the male and the female connector 101, 102, 100, 200, 300, 400.

Moreover, the outer housing 490, in most embodiments the female multi-conductor cable connector, may include a securing mechanism 421. The securing mechanism 421 may have a latch arm 423, a lock button 425, and a latch head 424. The latch head 424 may be a ramped surface, a wedge, a bump, or any protrusion located at a distal end of the latch arm 423, relative to the end that communicates with the lock button 425. In one embodiment, latch head 424 may have a ramped surface(s) to releasably engage the male outer housing 190. The securing mechanism 421 may be built into the outer housing 490, may be located proximate the outer housing 490, or may be disposed proximate or otherwise near the first end 441 of the contact receiver 440. A lock button 425 may be operably associated with the latch arm 423 and latch head 424 to releasably secure a corresponding male multi-conductor cable connector, such as connector 101, to the female multi-conductor cable connector 400. The lock button 425 may be exposed and/or accessible on the outer surface 494 of the outer housing 490. Those skilled in the art should appreciate that securing means 421 may be a variety of securing means typically associated with multi-conductor cables, such as XLR type cables. In most embodiments, the latch arm 423 may contact the contact receiver 440. For instance, the latch 423 may rest upon the contact receiver 440.

The female outer housing 490 may also include a contact receiver 440 disposed, positioned, located, etc. substantially within and/or partially within the outer house 490. Substantially within the outer housing may refer to an overwhelming majority of the contact receiver 440 located within the outer housing 490. For instance, a portion of the contact receiver 440 may protrude from the outer housing 490. In another embodiment, the contact receiver 440 extends a distance (e.g. axial distance) from the outer housing 490 (e.g. from the second end 492 of the outer housing 490). In other words, the female outer housing 490 may surround or substantially surround the contact receiver 440. In one embodiment, the contact receiver 440 fits snugly within the female outer housing 490, while a portion of the contact receiver 440 protrudes or axially extends a distance beyond the second end 492 of the outer housing 490. The size of the portion of the contact receiver 440 that protrudes from the outer housing 490 and/or the distance that the contact receiver 440 extends beyond the second end 492 of the outer housing 490 may vary depending on the desired deflection, compression, and radial expansion of the contact receiver 440. For example, the further a portion of the contact receiver 440 protrudes, extends, etc., beyond the second end 492 of the outer housing 490 the greater the force of axial compression required to achieve a fully mated position, which may correlate with a greater radially expansive force of the contact receiver 440 within the outer housing 490 to simultaneously bias the latch arm 423 resting upon the contact receiver 440 and provide firm electrical contact between female-type contacts and incoming or received male contacts.

Furthermore, contact receiver 440 may have a first end 441, second end 442, outer edge surface 443, an outer surface 444, a back edge surface 445, a lip 447, a recessed surface 448, and contact engagement surfaces 449*a*, 449*b*. The outer edge surface 443 is proximate or otherwise near the second end 442 of the contact receiver 440, and may be configured to engage a corresponding multi-conductor cable connector, such as a male multi-conductor cable connector, when in a mated position. In one embodiment, the outer edge surface 443 may mate, touch, engage, etc. a contact plate 95 of a corresponding male connector, such as connector 101, when in a mated position. The back edge surface 445 of the contact receiver 440 is proximate or otherwise near the first end 441. The back edge surface 445 may contact, abut, touch, or reside substantially near the spacer 135, the connector body 50, and/or other components associated with the cable connection portion 414. Furthermore, the contact receiver 440 may include a recessed surface 448 proximate the first end 441, which may extend axially from the first end 441 to the lip 447. The recessed surface 448 may extend annularly, partially annularly, or a circumferential distance around the contact receiver 440 sufficient to allow placement of the latch arm 423 of the securing mechanism 421. The recessed surface 448 may be recessed, or positioned a distance below the outer surface 444 of the contact receiver 440; the recessed distance may be defined by the lip 447. In some embodiments, the recessed surface 448 accommodates the securing mechanism 421, in particular the latch arm 423 and/or latch head 424. For instance, the latch arm 423 may rest upon and physically contact the recessed surface 448 of the contact receiver 440 while the latch head 424 resides proximate the lip 447.

With continued reference to FIGS. 9 and 10, the contact receiver 440 may include a plurality of openings 426, 427, 428 that may accept, accommodate, receive, support, and/or guide a plurality of non-concentrically aligned contacts, such as the first, second, and third contacts 110, 120, 130. In most embodiments, the plurality of openings 426, 427, 428 may include a first receptive contact opening 426, which corresponds to the first contact 110, a second receptive contact opening 427, which corresponds to the second contact 120, and a third receptive contact opening 428 which corresponds to the third contact 130. The orientation of the first, second, and third receptive contact openings 426, 427, 428 may correspond to the non-concentric alignment of the contacts 110, 120, 130 from a corresponding male multi-conductor cable connector, such as a connector 101. The plurality of openings 426, 427, and 428 of the contact receiver 440 may also include more than one contact 110, 120, 130 in the same tubular opening 426, 427, 428. For instance, in a mated position, a contact 130 from a corresponding male multi-conductor cable connector, such as connector 101, may enter opening 428 and engage a socket 470 of a contact 130 belonging to a female multi-conductor cable connector, such as multi-conductor cable connector 400. Similarly, in a mated position, a contact 120 from a corresponding male multi-conductor cable connector, such as connector 101, may enter opening 427 and engage a contact 120 belonging to a female multi-conductor cable connector, such as multi-conductor cable connector 400. Further, in a mated position, a contact 110 from a corresponding male multi-conductor cable connector, such as connector 101, may enter opening 426 and engage a contact 110 belonging to a female multi-conductor cable connector, such as multi-conductor cable connector 400. The physical and electrical contact between the male contacts and female contacts can establish an electrical path through the connector 400. Moreover, the plurality of openings 426, 427, 428 may extend, axially or otherwise, from the first end 441 to the second end 442 of the contact receiver 440. The plurality of openings 426, 427, 428 extending axially through the contact receiver 440 may be defined by contact engagement surfaces. FIG. 9 only shows contact engagement surfaces 449*a*, 449*b*, which correspond to opening 428 and electrical contact 130. When a contact 130 is positioned within opening 428 of the contact receiver 440, the contact engagement surfaces 449*a*, 449*b* of the contact receiver 440 may contact and/or generally surround contact 130.

Figure 12:
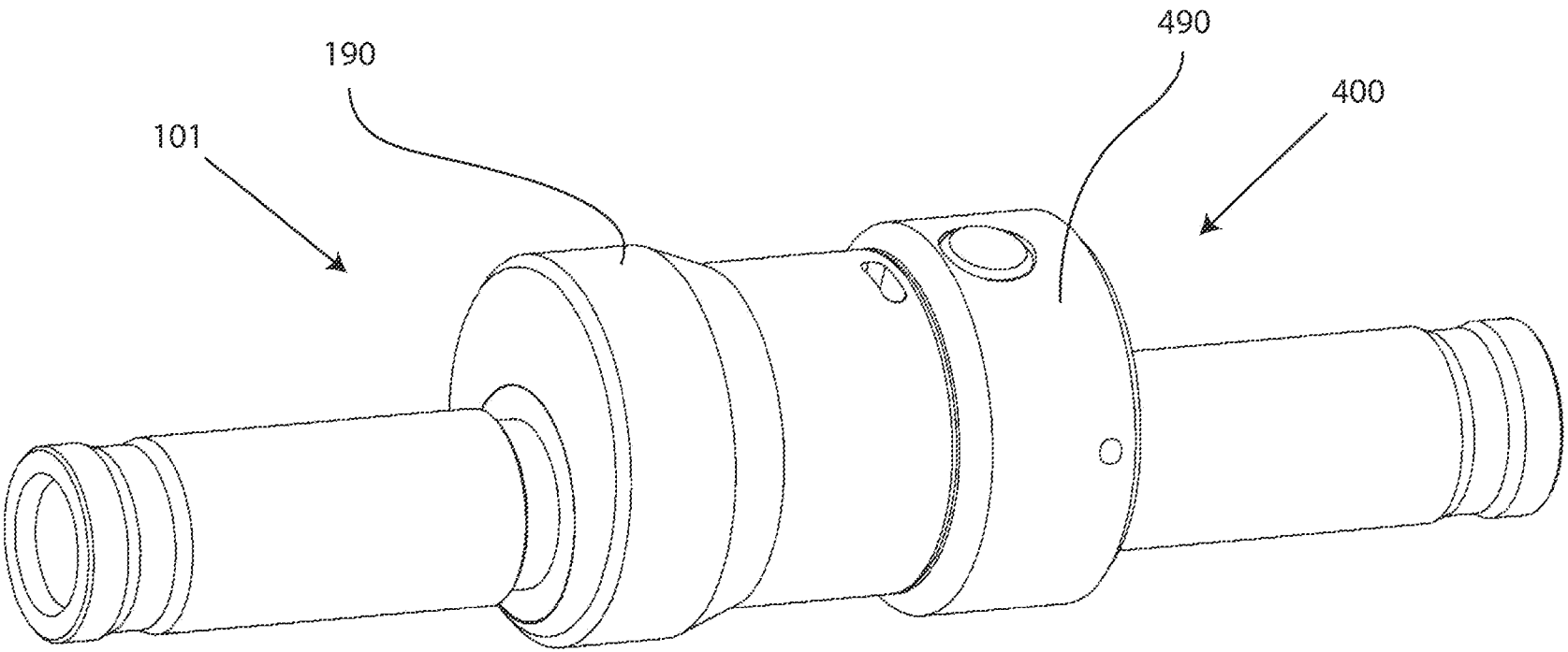
FIG. 12 depicts a perspective view of the fourth embodiment of the multi-conductor cable connector in a mated position.

Referring now to FIG. 12, an embodiment of a multi-conductor cable connector 400 is shown in a mated position with a male-type multi-conductor cable connector, such as connector 101. When the multi-conductor cable connector 400 is in a mated position with a corresponding multi-conductor cable connector, the contact receiver 440 may radially expand against the latch arm 423 of the securing mechanism 421 and also radially expand against the electrical contact(s) 110, 120, 130 positioned within the plurality of openings 426, 427, 428 when connector 400 is in a mated position because the contact receiver 440, or a portion thereof, of connector 400 protrudes from the second end 492 of the outer housing 490. The corresponding multi-conductor cable connector presses against the outer edge 443 of the contact receiver 440 while in a mated position. In most embodiments, the corresponding multi-conductor cable connector is a male multi-conductor cable connector, such as connector 101. The radial expansion of the contact receiver 400 within the outer housing 490 may occur due to an axial force exerted onto the contact receiver 400, in particular, the protruding portion of the contact receiver 440 by the corresponding multi-conductor cable connector while being mated (i.e. in a mated position). The axial force compresses the contact receiver 440 in an axial direction, which may result in radial expansion of the contact receiver 440, which ultimately may result in an outward radial force exerted by the contact receiver 440. The outward radial forces caused by the axial compression of the contact receiver 440 may support the may support the latch arm 423 of the securing mechanism 421 by biasing it outward. The outward movement of the latch arm 423 may provide more retention force between mated connectors.

Additionally, the displacement of the contact receiver 440 caused by the axial compression of the contact receiver 400 also establishes and maintains firm physical and electrical contact between the contact(s) 110, 120, 130 positioned within the openings 426, 427, 428 of the contact receiver 440. For example, in a mated position, the contact receiver 440 may surround the contact(s) 110, 120, 130 and lend radial support to the physical and electrical connection between an electrical contact 110, 120, 130 and an incoming or received electrical contact 110, 120, 130 from a corresponding multi-conductor cable connector, such as connector 101, when compressed. In one embodiment, the radially force of the contact receiver 440 facilitates firm physical and electrical contact between the socket 470 of an electrical contact 110, 120, 130 and an incoming or received electrical contact 110, 120, 130 from a corresponding multi-conductor cable connector, such as connector 101. The sockets 470 of the electrical contacts 110, 120, 130 may be slotted to allow radial movement of the socket to enhance electrical communication between the socket 470 and the incoming or received electrical contact 110, 120, 130 of a corresponding multi-conductor cable connector. For example, when the contact receiver 440 radially expands against the socket 470 to bias the socket 470, the socket 470 may also radially compress to ensure constant physical and electrical contact.

Therefore, the contact receiver 440 of connector 400 may simultaneously bias the securing means 421 (e.g. latch arm 423) and establish and maintain firm electrical and physical contact between the contact(s) 110, 120, 130 positioned within the openings 426, 427, 428 of the contact receiver 440. Those skilled in the art should appreciate the advantages of simplifying the assembly of a multi-conductor cable connector, such as connector 100, 200, 300, 400 by simultaneously improving electrical contact and improving the latching means.

The contact receiver 440 may also be an elastomeric member, an elastomer, an elastomer member, resilient member, or any element that may deform, deflect, compress, and/or respond to compressive forces. The contact receiver 440 should be resilient, and should be formed of non-conductive materials, such as rubber, elastomer, or other polymeric material. Manufacture of the contact receiver 440 may include casting, extruding, cutting, turning, drilling, compression molding, injection molding, spraying, or other fabrication methods that may provide efficient production of the component.

Referring to FIGS. 1-12, a method of improving physical and electrical contact with non-concentrically aligned electrical contacts 120, 120, 130 may include the steps of providing a cable connection portion 414 including: a post 40, configured for receiving a prepared portion of a multi-conductor cable 10, 11, a conductive member 80 radially disposed over the post 40, wherein the conductive member 80 has a first end 81 and a second end 82, and a connector body 50 physically and electrically contacting the conductive member 80 proximate the second end 82 of the conductive member 80, and providing a multi-contact portion 413 including: a plurality of electrical contacts 110, 120, 130 non-concentrically aligned with the cable connection portion 414, an outer housing 490 disposed over the connector body 50, a contact receiver 440 having a first end and 441*a* second end 442, the contact receiver 440 positioned substantially within the outer housing 490, wherein a portion of the contact receiver 440 axially protrudes a distance beyond the outer housing 490, wherein, when in a mated position, the contact receiver 440 is axially compressed and radially expands outward to bias against the plurality of electrical contacts. In many embodiments of the method of improving physical and electrical contact with non-concentrically aligned electrical contacts 120, 120, 130, the plurality of electrical contacts 110, 120, 130 are female terminal pins, that may engage, contact, accept, touch, etc., incoming or received electrical contacts 110, 120, 130 of a corresponding multi-conductor cable connector, such as a male multi-conductor cable connector. Furthermore, the electrical contact(s) 110, 120, 130, may be configured to engage within one of the plurality of openings 426, 427, 428. For example, in opening 428, a female electrical contact may physically and electrically engage an incoming or received male electrical contact.

With reference to FIG. 13, connectors 100, 200, 300, 400 may be configured to receive a first embodiment of a multi-conductor cable, such as multi-conductor cable 10, or receive a second embodiment of a multi-conductor cable, such as multi-conductor cable 11. The multi-conductor cable 11 may include a center conductive strand 18*b*, surrounded by an interior dielectric 16; the interior dielectric 16 may possibly be surrounded by a conductive foil layer 15; the interior dielectric 16 (and the possible conductive foil layer 15) is surrounded by a first conductive strand layer 14*a*; the first conductive strand layer 14*a* is surrounded by a first protective outer jacket 12*a*, wherein the first protective outer jacket 12*a* has dielectric properties and serves as an insulator; the first protective outer jacket 12*a* is surrounded by a second conductive strand layer 14*b*; and, the second conductive strand layer 14*b* is surrounded by a second protective outer jacket 12*b*. Thus, multi-conductor cable 11 may share the same structure and features of multi-conductor cable 10, except that multi-conductor cable 11 may have a center conductive strand 18*b* which protrudes from the dielectric 16. For instance, the center conductive strand 18*b* may protrude and/or extend from the dielectric 16 and enter a socket of a female type electrical contact. The multi-conductor cable 11 may be prepared similar to the multi-conductor cable 10, with further preparation of the multi-conductor cable 11 including stripping the dielectric 16 (and potentially conductive foil layer 15) to expose a portion of the center conductive strand 18*b*.

Referring now to FIGS. 1-13, a first embodiment of a method of forming a multi-conductor cable 100, 200, 300, 400 connection is discussed. The method comprises a step of providing a multi-conductor cable connector, such as, for example, multi-conductor cable connector embodiments 100, 200, 300, or 400. The provided multi-conductor cable connector 100, 200, 300, 400 includes a cable connection portion 114, 214, 314, 414. The cable connection portion 114, 214, 314, 414 includes a post 40, wherein the post 40 may be configured for receiving a prepared portion of a multi-conductor cable 10. The cable connection portion 114, 214, 314, 414 may also include a conductive member 80 radially disposed over the post 40, wherein the conductive member 80 has a first end 81 a second end 82. The cable connection portion 114, 214, 314, 414 also includes a connector body 50. The connector body 50 may physically and electrically contact the conductive member 80 proximate the second end 82 of the conductive member 80. The provided multi-conductor cable connector, such as connector embodiments 100, 200, 300, or 400 also includes a plurality of corresponding electrical contacts 110, 120, 130, or 210, 220, 230, or 310, 320, 330, wherein the electrical contacts, such as contacts 110, 120, 130 or 210, 220, 230, or 310, 320, 330 may be positioned in non-concentric alignment with the cable connection portion 114, 214, 314 or 414. An additional method step of forming a multi-conductor cable connection 114, 214, 314, 414 includes mating the multi-conductor cable connector 100, 200, 300, 400 with a separate device (not shown), the separate device having a corresponding plurality of mating electrical contacts (for mating with the contacts 110, 120, 130 or 210 220, 230, or 310, 320, 330), to complete the electrical connection, which completed electrical connection effectively extends through the embodiment of the multi-conductor cable connector 100, 200, 300, 400.

Furthermore, a second embodiment of a method of forming a multi-conductor cable 100, 200, 300, 400 connection may include providing a cable connection portion 114, 214, 314, 414 wherein the cable connection portion 114, 214, 314, 414 receives a prepared cable 10, 11 having a plurality of conductive strands 14*a*, 14*b*, concentrically sharing a common central axis, and a multi-contact portion 113, 213, 313, 414 coupled to the cable connection portion 114, 214, 314, 414 the multi-contact portion 113, 213, 313, 413 having a plurality of contacts 110, 120, 130 or 210 220, 230, or 310, 320, 330, non-concentrically aligned with the cable connection portion 114, 214, 314, 414 and mating the multi-conductor cable connector 100, 200, 300, 400 with a separate device having a corresponding plurality of mating electrical contacts 110, 120, 130 or 210 220, 230, or 310, 320, 330 to complete the electrical connection.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A multi-conductor cable connector comprising:

a contact receiver, having a first end and a second end, disposed substantially within an outer housing of the multi-conductor cable connector, wherein a portion of the contact receiver extends an axial distance beyond the outer housing; and a plurality of openings surrounded by the contact receiver;

a plurality of electrical contacts disposed within the plurality of openings, the plurality of electrical contacts configured to receive a plurality of non-concentrically aligned electrical contacts;

wherein axial compression of the contact receiver when the multi-conductor cable connector is in a mated position with a corresponding multi-conductor cable connector establishes and maintains firm electrical and physical contact between the plurality of electrical contacts and the received non-concentrically aligned electrical contacts.

2. The multi-conductor cable connector of claim 1, wherein axial compression of the contact receiver occurs when the contract receiver engages a plate of the corresponding multi-conductor cable connector.

3. The multi-conductor cable connector of claim 1, further including a securing mechanism positioned proximate the contact receiver, the securing mechanism having a latch arm, wherein the axial compression of the contact receiver also biases the latch arm of the securing mechanism.

4. The multi-conductor cable connector of claim 1, wherein, when in the mated position, the contact receiver is displaced in every direction.

5. The multi-conductor cable connector of claim 1, wherein the received non-concentrically aligned electrical contacts are male terminal pins from the corresponding multi-conductor cable connector.

6. The multi-conductor cable connector of claim 1, further comprising a cable connection portion operably connected to the outer housing.

7. The multi-conductor cable connector of claim 1, wherein the contact receiver is an elastomer.

8. A multi-conductor cable connector comprising:

an elastomeric member positioned substantially within an outer housing of a multi-contact portion of the multi-conductor cable connector, wherein a portion of the elastomeric member protrudes from the outer housing, the elastomeric member surrounding at least one electrical contact, the at least one electrical contact having a socket positioned at one end of the electrical contact;

wherein, when in a mated position with a corresponding multi-conductor cable connector, the elastomeric member engages a surface of the corresponding multi-conductor cable connector causing the elastomeric member to be axially compressed and radially expanded to bias the at least one electrical contact.

9. The multi-conductor cable connector of claim 8, wherein the axial compression of the elastomeric member biases a component of a securing mechanism, the securing mechanism being located proximate the elastomeric member.

10. The multi-conductor cable connector of claim 8, wherein the multi-contact portion is coupled to a cable connection portion.

11. The multi-conductor cable connector of claim 8, wherein the cable connection portion is a compression connector.

12. The multi-conductor cable connector of claim 8, wherein the elastomeric member radially expands outward to bias against the socket of the at least one electrical contact.

13. The multi-conductor cable connector of claim 8, wherein the corresponding multi-conductor cable connector is a male multi-conductor cable connector.

14. A multi-conductor cable connector comprising:

a cable connection portion, wherein the cable connection portion receives a plurality of conductive strands; and a multi-contact portion coupled to the cable connection portion, the multi-contact portion including:

an outer housing disposed over a connector body;

a contact receiver having a first end and a second end, the contact receiver positioned substantially within the outer housing, wherein a portion of the contact receiver proximate the second end axially protrudes a distance beyond the outer housing;

wherein the multi-conductor cable connector further includes a plurality of electrical contacts at least partially disposed within a plurality of openings of the contact receiver, the plurality of electrical contacts are in communication with the plurality of conductive strands received by the cable connection portion;

wherein the contact receiver of the multi-contact portion compress to bias the plurality of electrical contacts when a corresponding multi-conductor cable connector engages the portion of the contact receiver.

15. The multi-conductor cable connector of claim 14, wherein each of the plurality of electrical contacts have a socket to facilitate acceptance of an incoming electrical contact.

16. The multi-conductor cable connector of claim 14, wherein the cable connection portions includes a post at least partially disposed within the outer housing, the post configured for receiving a prepared portion of a multi-conductor cable having the plurality of conductive strands, a conductive member radially disposed over the post, wherein the conductive member has a first end and a second end, and the connector body physically and electrically contacting the conductive member proximate the second end of the conductive member.

17. The multi-conductor cable connector of claim 14, wherein the contact receiver is axially compressed when in a mated position with a corresponding multi-conductor cable, such that the axial compression of the contact receiver causes the contact receiver to displace within the outer housing.

18. The multi-conductor cable connector of claim 15, wherein a displacement within the outer housing simultaneously biases a securing mechanism and provides firm electrical and physical contact between the socket of each of the plurality of electrical contacts and the incoming electrical contact.

19. The multi-conductor cable connector of claim 14, wherein each of the plurality of electrical contacts is a female terminal pin.

20. The multi-conductor cable connector of claim 15, wherein the incoming electrical contact is a male terminal pin of a corresponding multi-conductor cable connector.

21. The multi-conductor cable connector of claim 14, wherein the contact receiver is an elastomer.

22. A multi-conductor cable connector comprising:

a cable connection portion, wherein the cable connection portion receives a plurality of conductive strands;

a multi-contact portion coupled to the cable connection portion, the multi-contact portion having a plurality of electrical contacts in communication with the plurality of conductive strands, the plurality of electrical contacts configured to receive a plurality of non-concentrically aligned contacts of a corresponding multi-conductor cable connector; and means for establishing and maintaining electrical and physical contact between the plurality of electrical contacts and the received non-concentrically aligned electrical contacts, the means being a fixed component configured to compress the plurality of electrical contacts;

wherein the means also biases a latch arm of a securing mechanism of the multi-conductor cable connector.

23. A method comprising:

providing a multi-conductor cable connector having a cable connection portion and a multi-contact portion coupled to the cable connection portion, wherein the cable connection portion receives a plurality of conductive strands, the multi-contact portion including:

an outer housing;

a contact receiver having a first end and a second end, the contact receiver positioned substantially within the outer housing, wherein a portion of the contact receiver proximate the second end axially protrudes a distance beyond the outer housing;

a plurality of electrical contacts disposed within a plurality of openings of the contact receiver, the plurality of electrical contacts being in communication with the plurality of conductive strands received by the cable connection portion;

wherein, when the multi-conductor cable connector is in a mated position with a corresponding multi-conductor cable connector, the contact receiver engages a surface of the corresponding multi-conductor cable connector causing the contact receiver to be axially compressed and radially expanded to bias the plurality of electrical contacts;

wherein the contact receiver of the multi-contact portion biases the plurality of electrical contacts when a corresponding multi-conductor cable connector engages the portion of the contact receiver.

24. The method of claim 23, wherein the contact receiver is an elastomer.

25. The method of claim 23, wherein each of the plurality of electrical contacts is a female terminal pin.

* * * * *